US006859336B1

(12) United States Patent
Wada et al.

(10) Patent No.: US 6,859,336 B1
(45) Date of Patent: Feb. 22, 2005

(54) APPARATUS FOR PROCESSING A LENS

(75) Inventors: Toyoji Wada, Shinjyuku-ku (JP); Masahiko Samukawa, Shinjyuku-ku (JP)

(73) Assignee: Hoya Corporation, Tokyo (JP)

( * ) Notice: Subject to any disclaimer, the term of this patent is extended or adjusted under 35 U.S.C. 154(b) by 0 days.

(21) Appl. No.: 10/406,594

(22) Filed: Apr. 4, 2003

(30) Foreign Application Priority Data

Apr. 8, 2002 (JP) ..... 2002-105563

(51) Int. Cl.[7] ..... G02B 7/02; B24B 1/00; B24B 7/19; B24B 7/30

(52) U.S. Cl. ..... 359/819; 451/42; 451/43

(58) Field of Search ..... 359/819, 822; 451/42, 43, 390, 384; 351/177

(56) References Cited

U.S. PATENT DOCUMENTS 4,928,439 A 5/1990 Ramos et al.
5,053,971 A * 10/1991 Wood et al. ..... 700/164

FOREIGN PATENT DOCUMENTS

DE 196 32 340 A 2/1998
EP 1 310 326 A 5/2003
JP 6047656 2/1994
JP 2002018686 1/2002

OTHER PUBLICATIONS

European Search Report, completed Aug. 5, 2004.

* cited by examiner

*Primary Examiner*—Hung Xuan Dang
*Assistant Examiner*—Joseph Martinez
(74) *Attorney, Agent, or Firm*—Griffin & Szipl, P.C.

(57) ABSTRACT

An apparatus for processing a lens including a displaceable lens-holding unit comprising a holding shaft that holds the lens, and a means for detecting a rotation angle of the holding shaft; a means for processing a peripheral portion of the lens; an elevating and lowering unit that holds the lens-holding unit, wherein the elevating and lowering unit displaces to a first position in a vertical direction in accordance with a processing amount; wherein, when the lens-holding unit is lowered until the lens contacts the means for processing, the elevating and lowering unit is separate from the lens-holding unit, wherein the lens-holding unit is further lowered to the first position in the vertical direction in accordance with the processing amount, and the lens-holding unit presses the lens to the means for processing under a load determined in accordance with a weight of the lens-holding unit.

12 Claims, 20 Drawing Sheets

APPARATUS FOR PROCESSING A LENS

FIELD OF THE INVENTION

The present invention relates to an apparatus for processing a lens, which is used for processing the peripheral portion of a lens, such as a spectacle lens, to provide a prescribed shape so that the lens can be fitted into a lens frame of a spectacle frame.

BACKGROUND OF THE INVENTION

In the art of making lenses, when a lens, such as a spectacle lens, is processed so that the lens may be fitted into a lens frame of a spectacle frame, the peripheral face of an uncut lens is ground by a grinder, or cut by a cutter. In this manner, the peripheral portion of the uncut lens is form ed into a prescribed shape in accordance with data corresponding to the shape of the lens frame of the spectacle frame.

Prior art examples of the known processing apparatus for this purpose include, as disclosed in Japanese Patent Application Laid-Open No. 2002-18686, apparatuses in which a rotating tool (a grinder), which can be freely rotated to grind the peripheral face of the lens, is disposed around a shaft on a base. The position of lens grinding or cutting is set by driving a shaft supporting the lens, which can be freely swung relative to the shaft of the rotating tool, towards the shaft of the rotating tool by an arm, and rotating the lens around the axis thereof.

In these apparatuses, the depth of processing of the lens is decided in accordance with the swing angle of the arm, and the position of grinding is obtained in accordance with the rotation angle of the shaft of the lens. The peripheral portion of the lens is processed in this manner in accordance with data corresponding to the shape of the lens frame.

However, in the above prior art apparatuses, the lens processing depth of the lens is correlated to, and must be converted into, the swing angle of the arm. The calculation for converting the depth of lens processing of the lens into the swing angle of the arm is conducted by the control portion of the processing apparatus at portions along the entire periphery of the lens. This calculation has drawbacks in that, since many calculations of the floating point are required, and the data describing the shape of the lens frame is three dimensional data, the calculation load on the CPU (the microprocessor) of the control portion is very great, and the amount of time required before the calculation is completed at portions along the entire periphery of the lens (or the amount of data necessary for starting the processing) is very long. Therefore, a great time lag arises between the initial time directing the apparatus to start the processing of the lens (i.e., the time when the starting switch is pushed) and the time lens processing actually starts. Consequently, the entire time to complete the lens processing, including this time lag, increases. One solution for decreasing this time lag is to use a CPU having a greater calculation ability. However, the drawback of this solution is that the cost of installation of these type of calculation devices, such as a high performance CPU, markedly increases, which translates to increases in the cost of production of these apparatuses.

In the above conventional apparatuses, the lens is pressed to the rotating tool by the swing of the arm and the processing is conducted. However, the above apparatuses have drawbacks because the processing pressure (which is defined as the pressure of contact between the lens and the rotating tool) changes in a small amount depending on the swing angle. Therefore, it is necessary to finely control the arm at every swing angle in order to obtain a uniform processing pressure at every portion along the entire periphery of the lens while the arm applies force. Such fine control of the arm further increases the calculation load on the control portion because the required processing pressure varies depending on the material of the lens and the thickness of the peripheral portion of the lens.

Moreover, the above apparatuses have a further drawback in that various component mechanisms are arranged on a horizontal plane, which increases the size of the apparatus, and the area required for installation of the apparatus increases.

The present invention has been made to overcome the above problems and has an object of minimizing the production cost while minimizing the time required for converting the data describing the shape of the lens frame into the data necessary for the lens processing. Another object of the present invention is to improve the accuracy of lens processing by maintaining the processing pressure on the lens uniformly along the periphery of the lens.

SUMMARY OF THE INVENTION

The present invention provides an apparatus for processing a lens, which processes a peripheral portion of a spectacle lens in accordance with data describing a shape of a lens frame. In the apparatus, a holding shaft of a lens-holding unit, which is freely displaceable in a vertical direction while the lens is freely rotateable around a horizontal shaft, is disposed on a vertical line of a main shaft of a rotating tool of a means for processing, and an elevating and lowering unit supports the lens-holding unit at a desired position in the vertical direction. The lens processing is conducted as follows: the lens-holding unit is lowered while being supported by the elevating and lowering unit; when the lens is brought into contact with the rotating tool of the means for processing, the elevating and lowering unit is separated from the lens holding unit and further lowered to the first position in a vertical direction, which is determined in accordance with the processing amount for the lens calculated based on a specific rotation angle of the holding shaft and data corresponding to a shape of a lens frame at the specific rotation angle; and, after the lens-holding unit is separated from the elevating and lowering unit, a load calculated in accordance with the weight of the lens-holding unit itself is applied to the lens, and the lens is processed until the lens-holding unit is once again brought into contact with the elevating and lowering unit.

In accordance with the present invention, when the elevating and lowering unit is driven in the vertical direction in accordance with data describing the shape of the lens frame, the lens supported by the lens-holding unit is brought into contact with the rotating tool of the means for processing in the vertical direction while the lens is rotated, and the peripheral portion of the lens is processed. Since the processing amount for the lens is set in accordance with the position of the elevating and lowering unit, which is decided based on the specific rotation angle of the holding shaft and the data describing the shape of the lens frame at the specific rotation angle, the time required for converting the data describing the shape of the lens frame in accordance with the rotation angle of the holding shaft (i.e., the rotation angle of the lens) to the data necessary for the processing can be decreased in comparison with the time required for converting the amount of cutting (i.e., the processing depth) into the swing angle of an arm which supports a swinging lens-holding shaft in a conventional manner. Thus, the period of time from the time directing the start the lens processing to the time lens processing actually starts can be decreased; consequently, the entire time of processing can be decreased. Therefore, it is not necessary to practice the present invention with a microprocessor having a great processing ability because the calculation load is small. Thus, the manufacturing costs of production can be suppressed while the accuracy of lens processing in accordance with the data describing the shape of the lens frame is increased.

DETAILED DESCRIPTION OF ILLUSTRATIVE EMBODIMENTS OF THE INVENTION

An embodiment of the present invention will be described in the following with reference to Figures, wherein like parts are represented by like character references.

Figure 1:
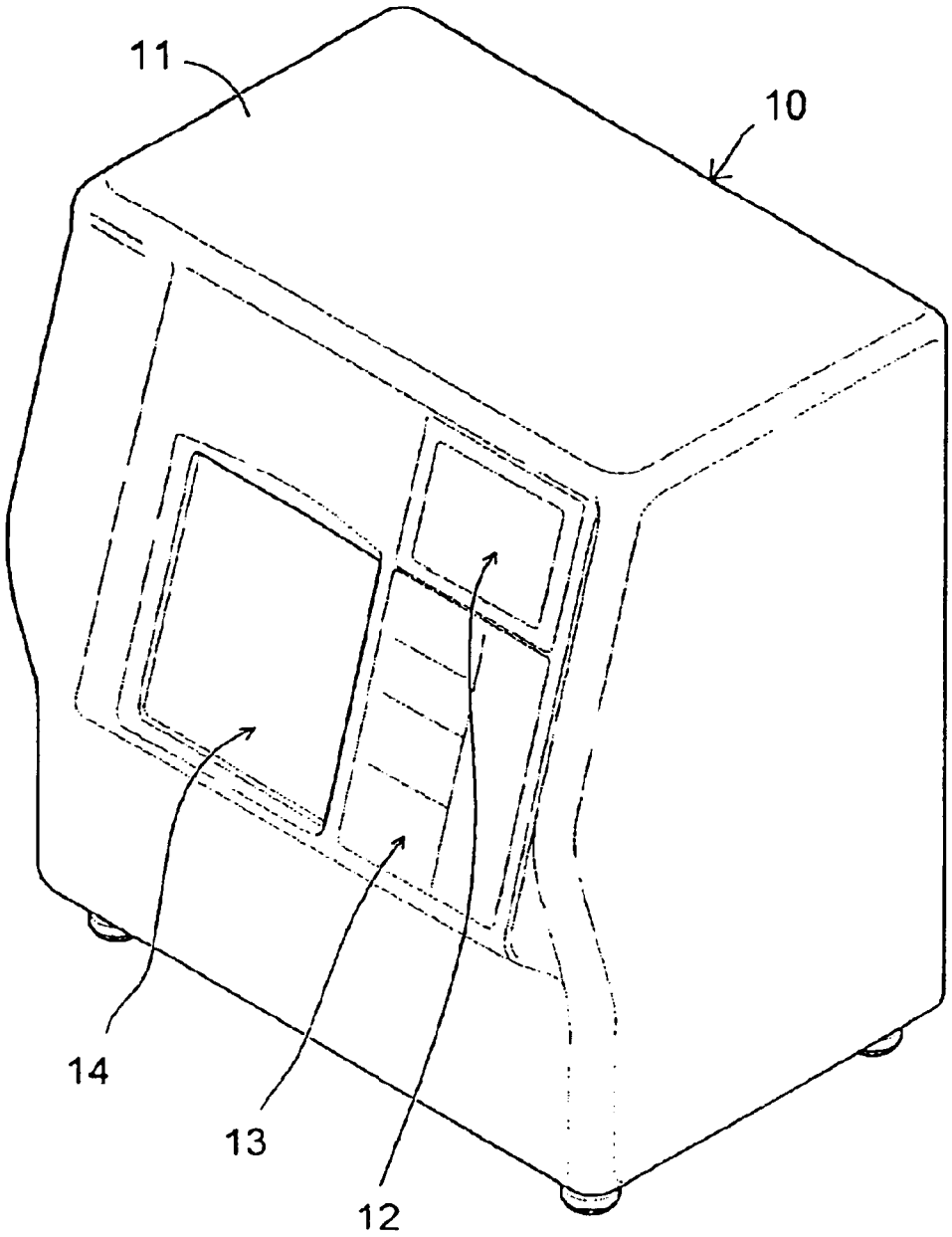
FIG. 1 shows a perspective view of the apparatus for processing a lens as an embodiment of the present invention.
Figure 3:
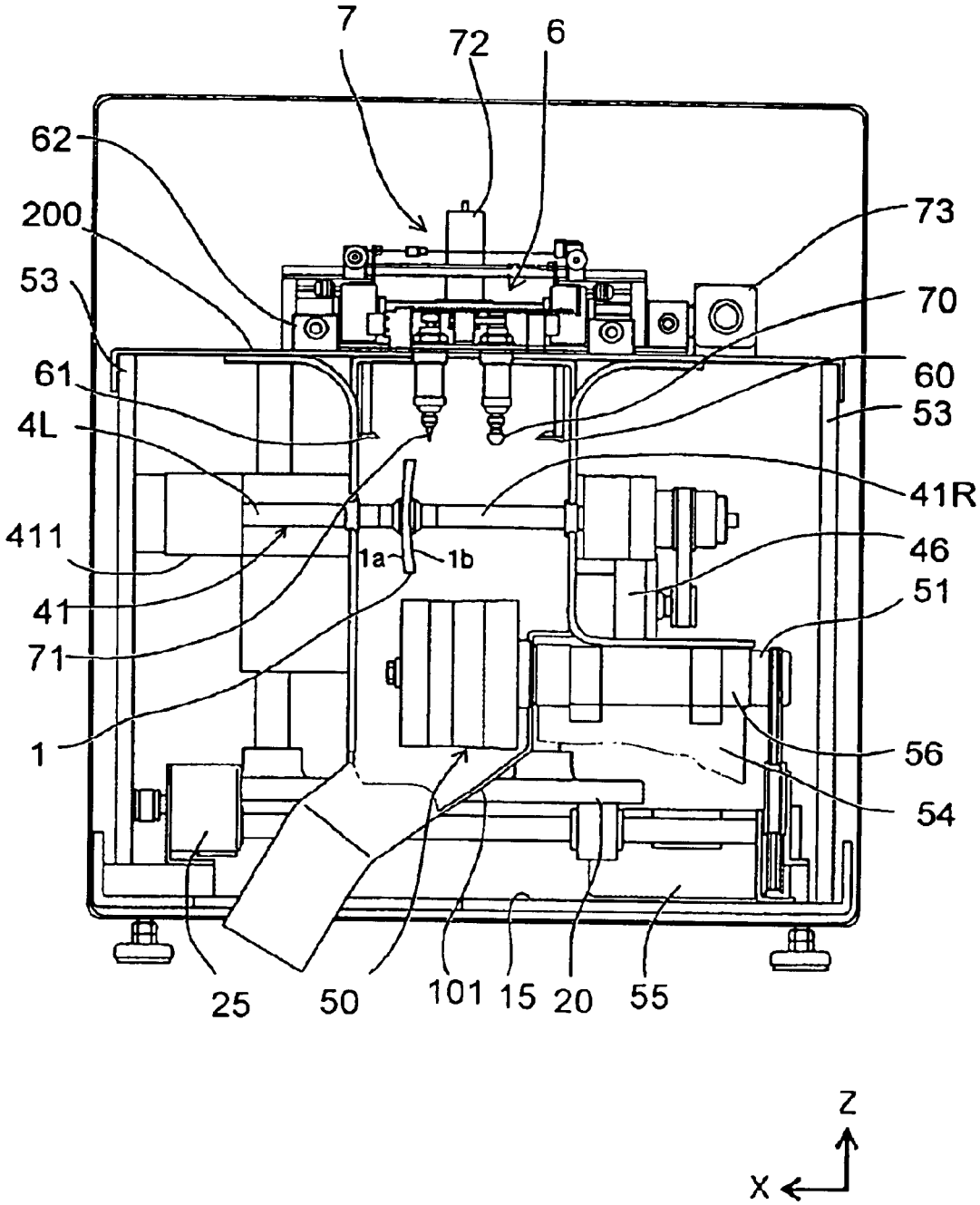
FIG. 3 shows a front view exhibiting the inner construction shown in FIG. 2.
Figure 4:
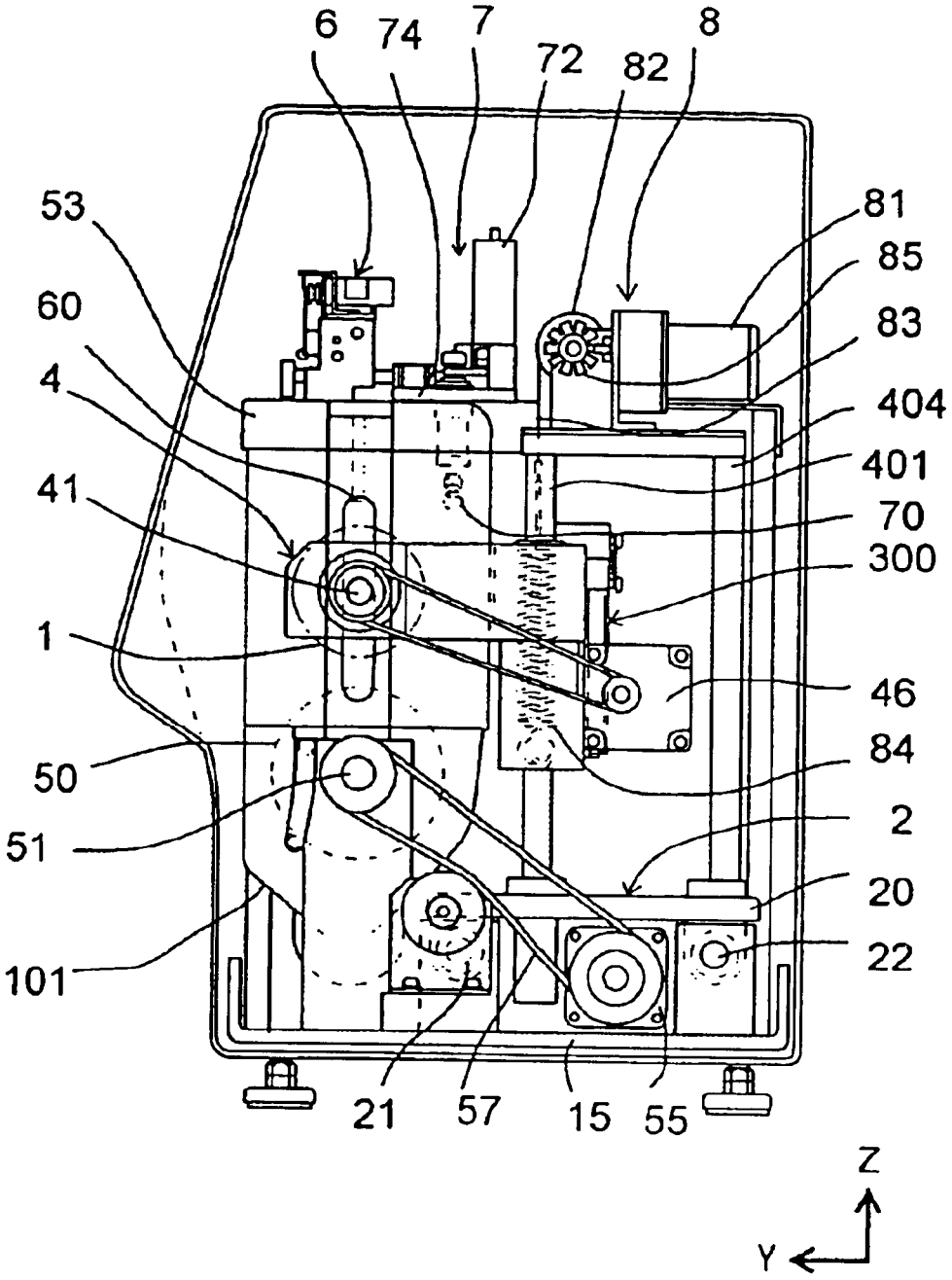
FIG. 4 shows a right side view exhibiting the inner construction shown in FIG. 2.

FIG. 1 is a perspective view of an apparatus 10 for processing a lens. FIGS. 3 and 4 show a front view and a right side view, respectively, exhibiting the inner construction of the lenses processing apparatus 10.

In FIG. 1, at the right side of the front of the lens processing apparatus 10, contained in a case 11 having the shape of a rectangular parallelepiped, is disposed an operation portion 13 for selecting or inputting the lens processing conditions for the lens and a display portion 12 for displaying information on the processing, such as the data describing the shape of the lens frame and the processing data used for the processing. The operation portion 13 includes touch panels, touch switches, keys, other manual controls, and the like. The display portion 12 includes LCD, CRT, other display assemblies and the like.

At the front center of the lens processing apparatus 10, a door 14 is disposed, which can be opened or closed as desired, and is used for inserting or taking out a lens.

After the interior construction of the lens processing apparatus 10 is generally described, various members and portions will be described in detail.

General Outline of the Interior Construction of the Lens Processing Apparatus

Figure 2:
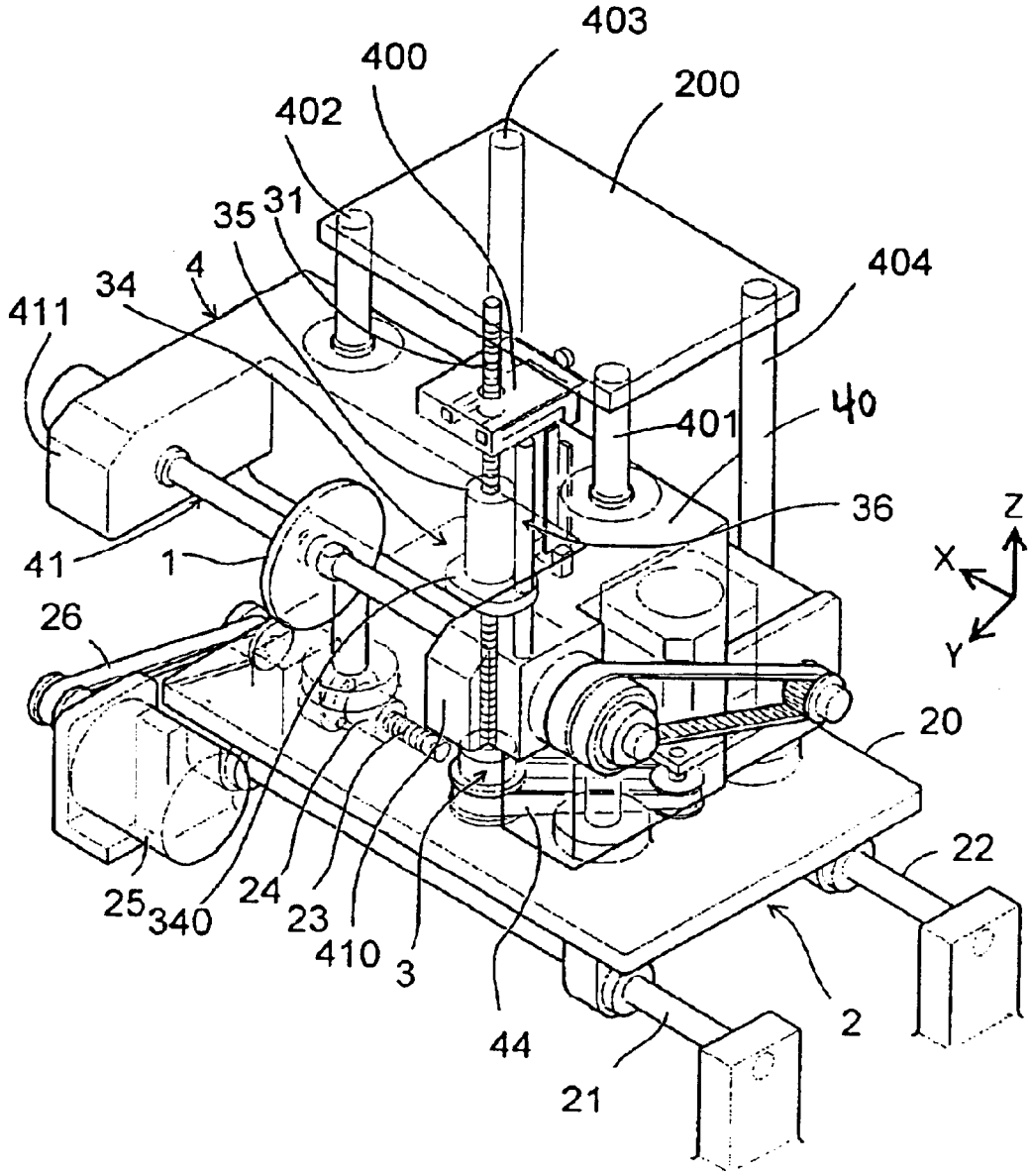
FIG. 2 shows a perspective view exhibiting the main portions of the inner construction of the apparatus in FIG. 1.

In FIGS. 2, 3 and 4, a base unit 2, which can be displaced in the direction parallel to a main shaft 51 (i.e., the direction of the X-axis in FIGS. 2 and 3), is disposed inside of the case 11. The base unit 2 supports a lens unit 4 (also called a "a lens-holding unit"), which can be displaced in the vertical direction (i.e., in the direction of the Z-axis in the Figures).

The direction from the right to the left in FIG. 3 (i.e., the transverse direction of the apparatus for processing a lens 1) is assigned to the X-axis, the vertical direction (i.e., the direction of the height of the apparatus) is assigned to the Z-axis, and the direction from the left to the right in FIG. 4 (i.e., the direction towards the inside of the apparatus) is assigned to the Y-axis. It is assumed that these axes orthogonally intersect each other to provide a conventional Cartesian coordinate system.

The lens unit 4 includes a lens-holding shaft 41, which is divided into two portions 41R, 41L and selectively holds the center of the lens 1 between the two portions. The lens-holding shaft 41 is disposed in a manner so that the lens-holding shaft is freely rotatable. The lens-holding shaft 41 is placed on the vertical line of a main rotating tool 50, which is a grinder or a cutter that is supported by a shaft on a base plate 15. The lens-holding shaft 41 and the main shaft 51 of a main rotating tool 50 are arranged parallel with each other along the X-axis.

For processing a lens 1, as shown in FIGS. 2 and 3, the center of the lens 1 is held between the two portions of the dividing lens-holding shaft 41. Lens holding shaft 41 divides at a prescribed position for holding and releasing the lens within apparatus 10, so that a prescribed distance is kept between the peripheral portion of the uncut lens 1 and the main rotating tool 50 when the lens-holding shaft catches or releases the lens 1. The lens unit 4 is subsequently lowered, after the main rotating tool 50 is rotated, and the peripheral portion (i.e., the outer peripheral portion) of the lens 1 is rotated by rotating the lens-holding shaft 41 so that lens grinding can occur.

Figure 19:
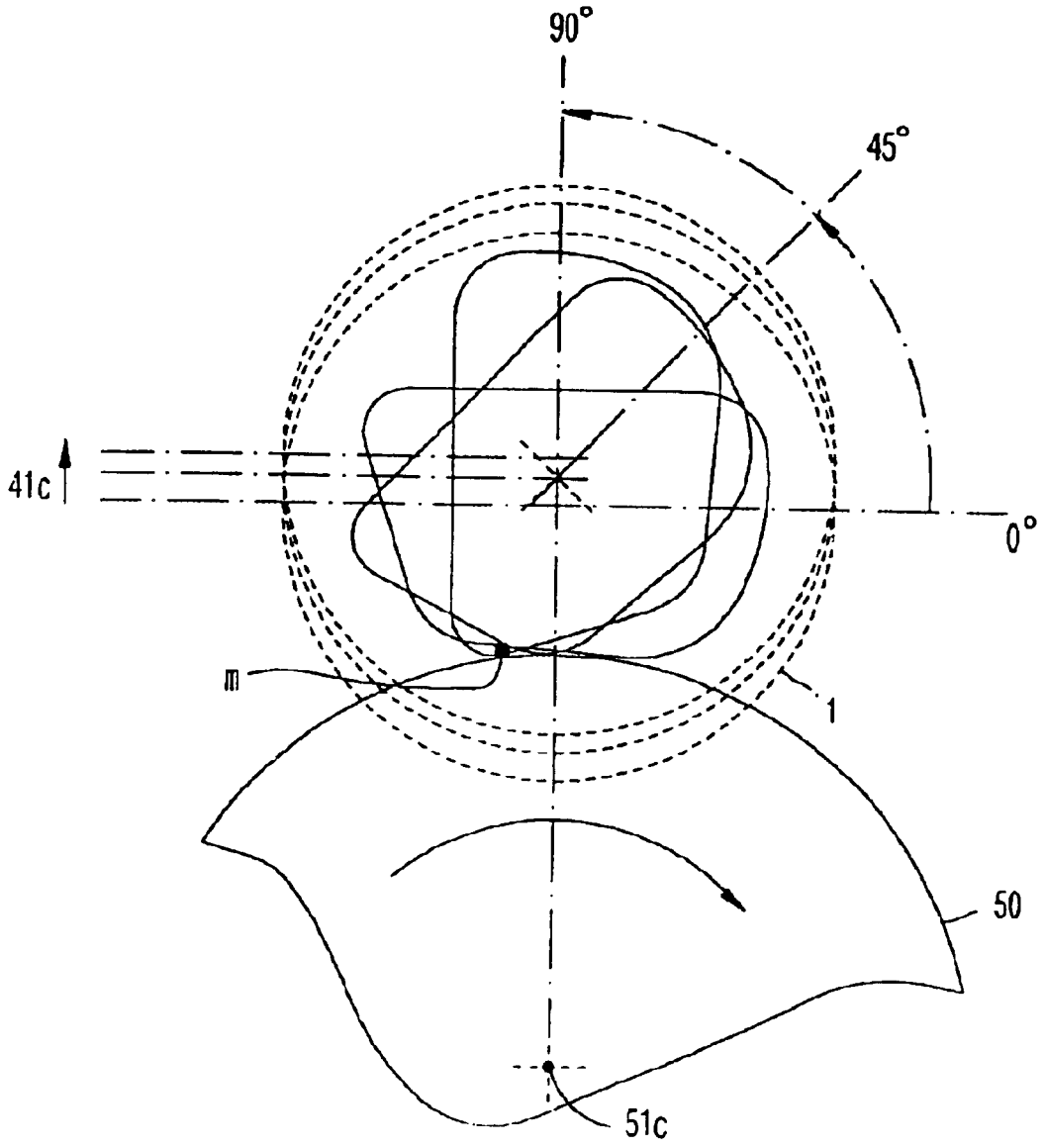
FIG. 19 is an expanded view of the lens and the main rotating tool during the processing.

As shown in FIG. 19, the processing depth is changed or varied by displacing the lens-holding shaft 41 along the shaft line 41*c* relative to the fixed main shaft 61 in the direction of the Z-axis, and the grinding position is decided in accordance with the rotation angle of the lens-holding shaft 41. By elevating or lowering the lens unit 4 based on the data describing the shape of the lens frame, the grinding of a lens is conducted in a continuous manner to achieve the desired processing depth in accordance with the rotation angle of the lens 1. During lens processing, the force pressing the lens 1 to the main rotating tool 50 is called the "processing pressure" and is provided by the weight of the lens unit 4 itself.

As evident from FIG. 3, the position of contact between the lens 1 and the main rotating tool 50 is changed by displacing the base unit 2 in the direction of the X-axis so that the selection between flat grinding and beveled grinding can be made. In a similar manner, switching between rough grinding and finishing grinding can also be performed.

Figure 11:
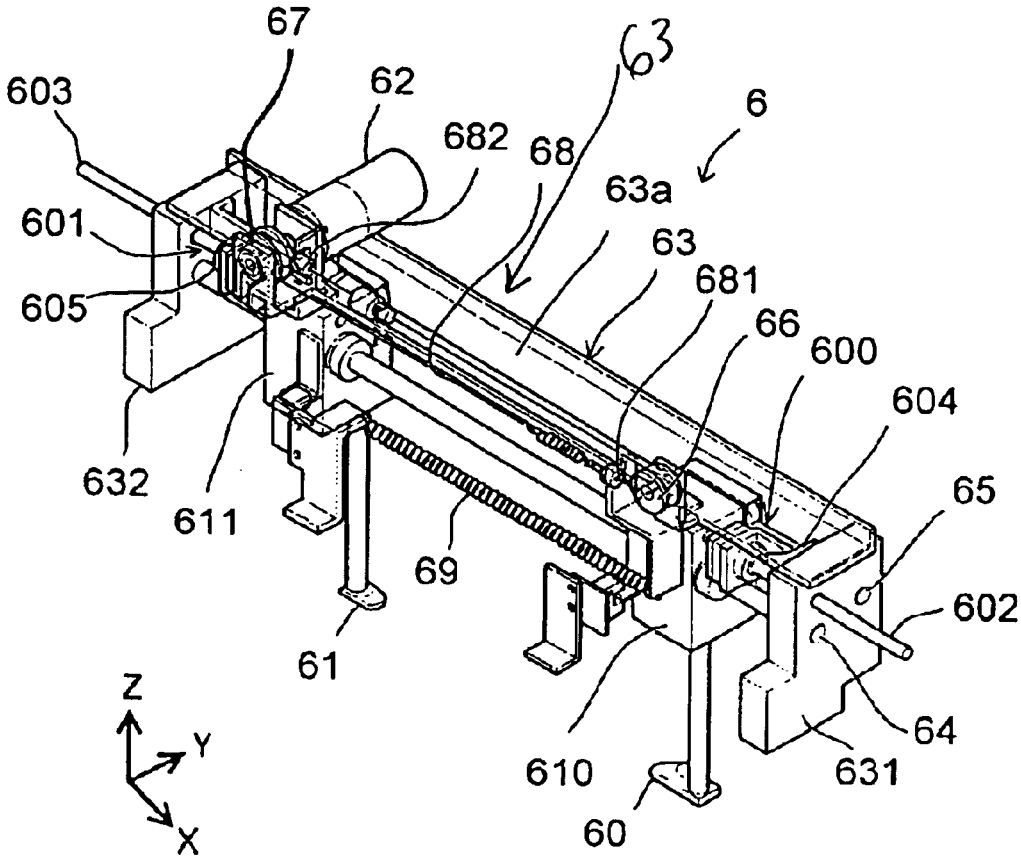
FIG. 11 shows a perspective view of the measuring unit.

As evident in FIGS. 3 and 11, a measuring unit 6 is fixed at a position above the lens unit 4, and comprises, as its main components, styluses 60 and 61, which can be displaced in the direction of the X-axis. For measuring the lens position, the styluses 60, or 61, are brought into contact with the concave face 1*b*, or the convex face 1*a*, respectively, while the lens unit 4 is in an elevated condition, and the lens unit 4 is elevated or lowered while the lens-holding shaft 41 is rotated.

As shown in FIG. 4, a finishing unit 7, which can be displaced in the direction of the Y-axis, is disposed at a position adjacent to the measuring unit 6 (i.e., towards the right side in FIG. 4). Rotating tools 70 and 71 of the finishing unit 7 are displaced to a vertical position relative to the holding shaft 41 and then driven for rotation. The peripheral portion of the lens 1 is processed by elevating the lens unit 4 until the peripheral portion of the lens contacts one of the rotating tools 70 and 71 while rotating the lens-holding shaft 41.

The rotating tool 70 is a spherical cutter for chamfering and the rotating tool 71 is constructed with end mills for grooving. Rotating tools 70 and 71 may be referred to as finishing tools.

Switching between the tools and switching between the positions of processing are conducted by displacing the lens unit 4 in the direction of the X-axis by driving the base unit 2.

Various portions of the inner construction of the lens processing apparatus 10 will be described in more detail as follows.

The Main Shaft Unit

In FIGS. 2, 3 and 4, the main shaft 51, upon which the rotating tool 50 (a grinder or a cutter having diamond or the like) is disposed and a motor 55 for driving the main shaft 51 are fixed to the base plate 15 inside of the case 11. The main shaft unit includes main shaft 51, rotating tool 50, and motor 55 as the main components.

The main shaft 51, as shown in FIGS. 3 and 4, is supported along the X-axis by a support shaft mounted on a tool frame 53 having a shape of a tower and a bracket 54 in a manner such that the main shaft 51 can be rotated freely around the support shaft.

In FIG. 3, the main rotating tool 50 for mechanically processing the lens 1 is attached to the main shaft 51 protruding from the bracket 54, standing on the base plate 15, to the left of bracket 54 as shown in FIG. 3. The main rotating tool 50 is placed at the center of the apparatus 10 in the direction of the X-axis in FIG. 3, and at the front side in FIG. 4 (i.e., at the left side in FIG. 4), and the main shaft 51 is disposed oriented along the X-axis. The outer periphery of the main shaft 51 is covered with the cover 56 of the main shaft located at the side of the bracket 54, so that the shaft bearing mechanism and the like of the main shaft 51 are protected from the cooling liquid used during lens processing.

Figure 5:
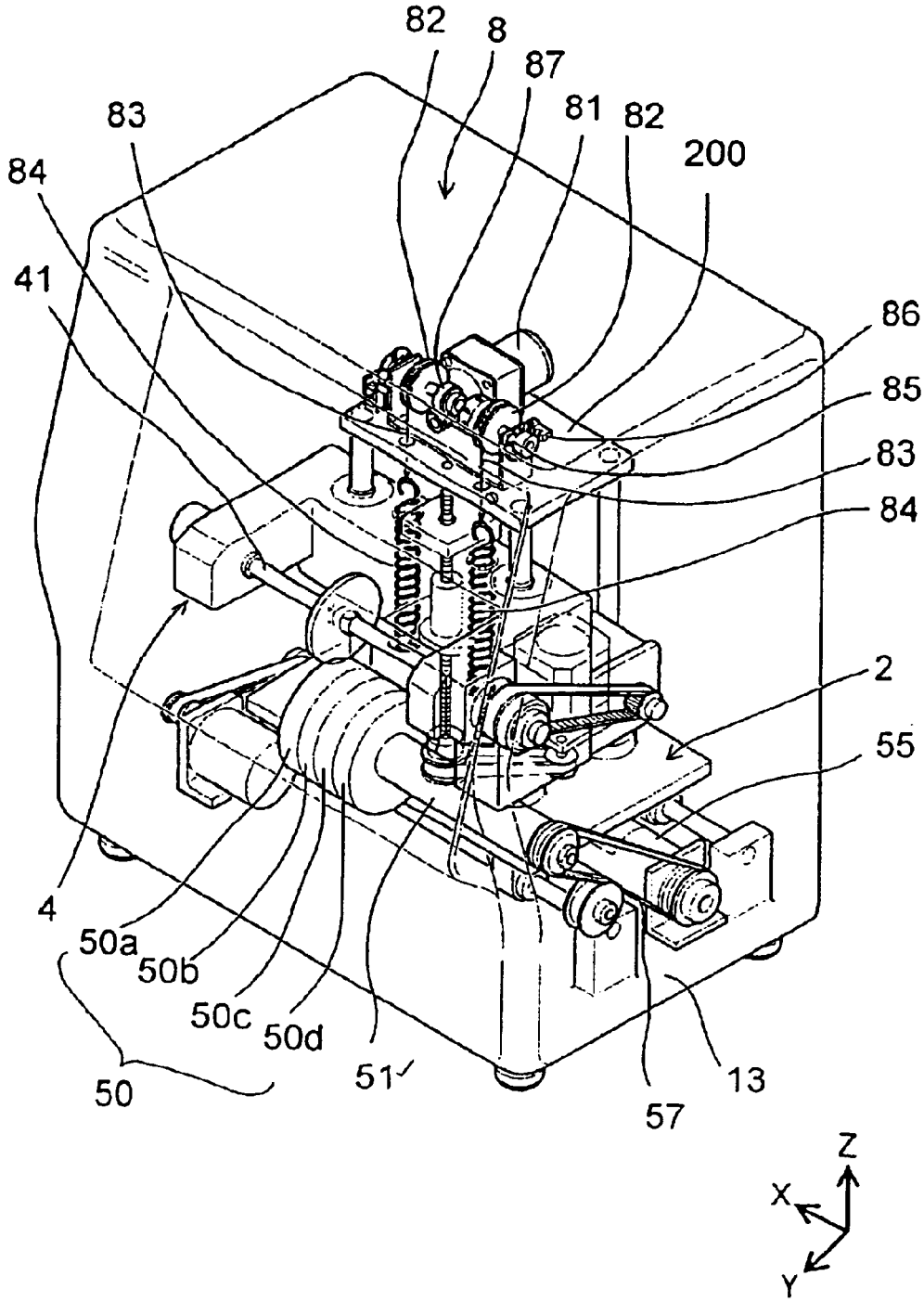
FIG. 5 shows a perspective view exhibiting the inner construction in the condition that the measuring unit and the processing unit are removed.

As shown in FIG. 5, the base end portion of the main shaft 51, shown at the right side in the Figure, is driven by a motor 55 via a belt 57 and pulleys serving as the transmission mechanism.

As shown in FIG. 5, the main rotating tool 50, which mechanically processes the lens, includes a rough grinder 50*a* for flat grinding, a finishing grinder 50*b* for flat grinding, a rough grinder 50*c* for beveled grinding and a finishing grinder 50*d* for beveled grinding, each disposed successively from the side of the tip of the main shaft 51 (i.e., from the left side in FIG. 5). In the alternative, grinding may also be conducted by using cutters as the rotating tool in place of the grinders without departing from the scope of the present invention.

The Base Unit

A base unit 2 for driving the lens unit 4 in the direction of the X-axis is disposed at a position posterior to the main shaft 51 in FIG. 4 (i.e., to the right side of the main shaft 51 in the Y-direction in FIG. 4).

As shown in FIG. 2, the base unit 2 includes a base 20, which can be displaced in the direction of the X-axis, and a servomotor 25 (hereinafter, referred to as the "X-axis motor"), which controls the positioning of the base 20 by driving the base in the direction of the X-axis.

The base 20 is disposed on guide members 21 and 22, which are fixed on the base plate 15 and oriented along the direction of the X-axis in a manner such that the base 20 can be freely displaced along the X-axis. Therefore, the base 20 can be freely displaced in the direction of the X-axis.

As shown in FIG. 2, an inner screw 23 is disposed at a position below the base 20 and between the guide members 21 and 22 in a manner such that the inner screw 23 can be rotated freely around its axis. An outer screw 24 fixed at the lower face of the base 20 is engaged with the inner screw 23 and the base 20 is driven in the direction of the X-axis by rotation of the screw 23. Screw 23 is driven to rotate by the X-motor 25.

One end of the inner screw 23 and the X-axis motor 25 are connected to each other via a gear and a cogged belt 26, and the base 20 is positioned in the direction of the X-axis in accordance with the rotation angle of the X-axis motor 25.

The Elevating and Lowering Unit

Disposed on the base 20, as shown in FIG. 2, are four poles 401, 402, 403 and 404. Among the four poles, the two poles 401 and 402 penetrate a frame 40 of the lens unit 4 so as to guide the lens unit 4 in the vertical direction (i.e., the direction of the Z-axis) in a manner such that the lens unit 4 can be displaced freely in the vertical direction.

Figure 6:
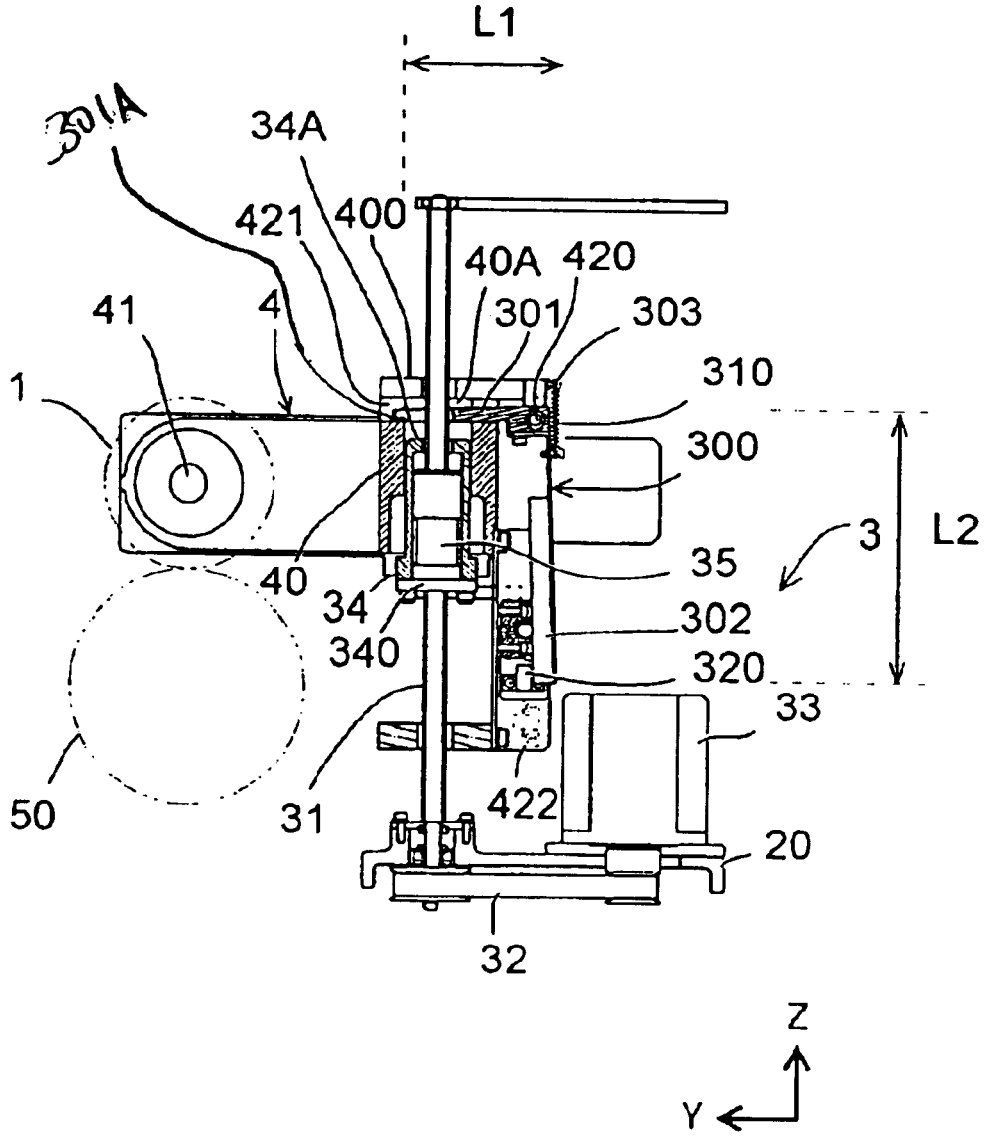
FIG. 6 shows a sectional view of the elevating and lowering unit and the lens unit in the vertical direction when the processing is started.

As shown in FIGS. 2 and 6, the lens unit 4 is driven in the vertical direction and positioned in the vertical direction by the elevating and lowering unit 3, which is displaced in the direction of the Z-axis. On the other hand, the lens unit 4 is positioned in the direction of the X-axis by the base unit 2 as discussed above.

Figure 8:
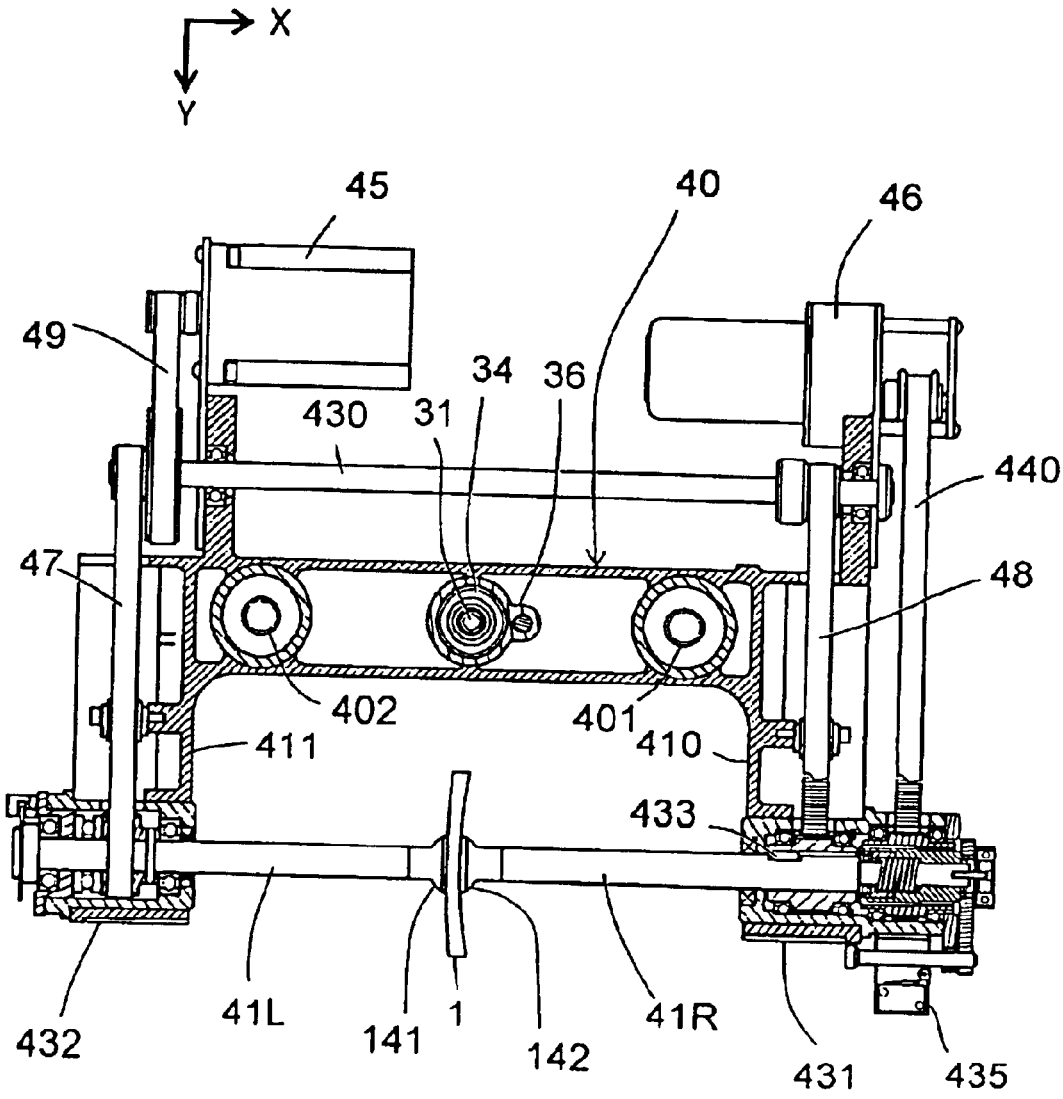
FIG. 8 shows a sectional view of the elevating and lowering unit and the lens unit in the horizontal direction in the condition that the lens is held by the lens-holding shafts.

The elevating and lowering unit 3, as shown in FIGS. 2, 6 and 8, includes the following: a screw 31, which is supported by a shaft on the base 20 between the poles 401 and 402 and penetrates the frame 40 of the lens unit 4 in the vertical direction; a positioning member 34, which is engaged with the screw 31 at the inner peripheral portion of the positioning member and which can support the lens unit 4 by contacting the frame 40 of the lens unit 4 at the upper end of the positioning member; and a servomotor 33 (hereinafter, referred to as a "Z-axis motor"), which is connected to the lower end of the screw 31 via a cogged belt 32 and a gear. The elevating and lowering unit 3 is disposed on the base 20.

In the elevating and lowering unit 3, the screw 31 is rotated by driving the Z-axis motor 33 so that the positioning member 34, having an outer screw 35 engaged with the screw 31, is driven in the direction of the Z-axis. The outer screw 35 is displaced in the direction of the Z-axis because the rotating movement in the circumferential direction is restricted by a mechanism at the lens unit 4, as is discussed later.

As shown in FIG. 6, the positioning member 34 is in contact with the inner periphery of a hole portion 40A, in the vertical direction, which is formed in the frame 40 of the lens unit 4 in a manner such that the positioning member 34 can slide and make a relative displacement in the vertical direction within hole portion 40A.

At the upper end of the hole portion 40A, a ceiling portion 400 connected to the frame 40 is disposed. As shown in FIGS. 2 and 8, along side of the outer screw 35 of the positioning member 34, a stopper 36 standing in the direction of the Z-axis is disposed at a position so that the stopper 36 can contact the lower face of the ceiling portion 400.

In FIG. 2, the stopper 36 is shown protruding from the upper portion of the positioning member 34 and is in contact with the lower face of the ceiling portion 400 so that the weight of the lens unit 4 applied by the ceiling portion 400 is supported by the positioning member 34, which includes both the stopper 36 and the outer screw 35. The outer screw 35 and the stopper 36 are connected to each other at each base portion through a base 340 of positioning member 34.

As evident from FIGS. 2 and 8, the hole portion 40A (see FIG. 6) of the frame 40 has a sectional shape such that the positioning member 34 and the stopper 36 fix each other around the Z-axis (i.e., in the direction perpendicular to the plane of FIG. 8) so that idle rotation of the outer screw 35 by the rotation of the screw 31 is prevented. In other words, the stopper 36 is fixed at the side of the outer screw 35 and connected to the outer screw 35 by base 340. Stopper 36 is arrested by the hole portion 40A so that the rotation of the positioning member 34 is also prevented. Thus, the outer screw 35 is elevated or lowered by the rotation of the screw 31 and the positioning member 34 is displaced in the direction of the Z-axis due to this movement of the outer screw member 35.

Figure 7:
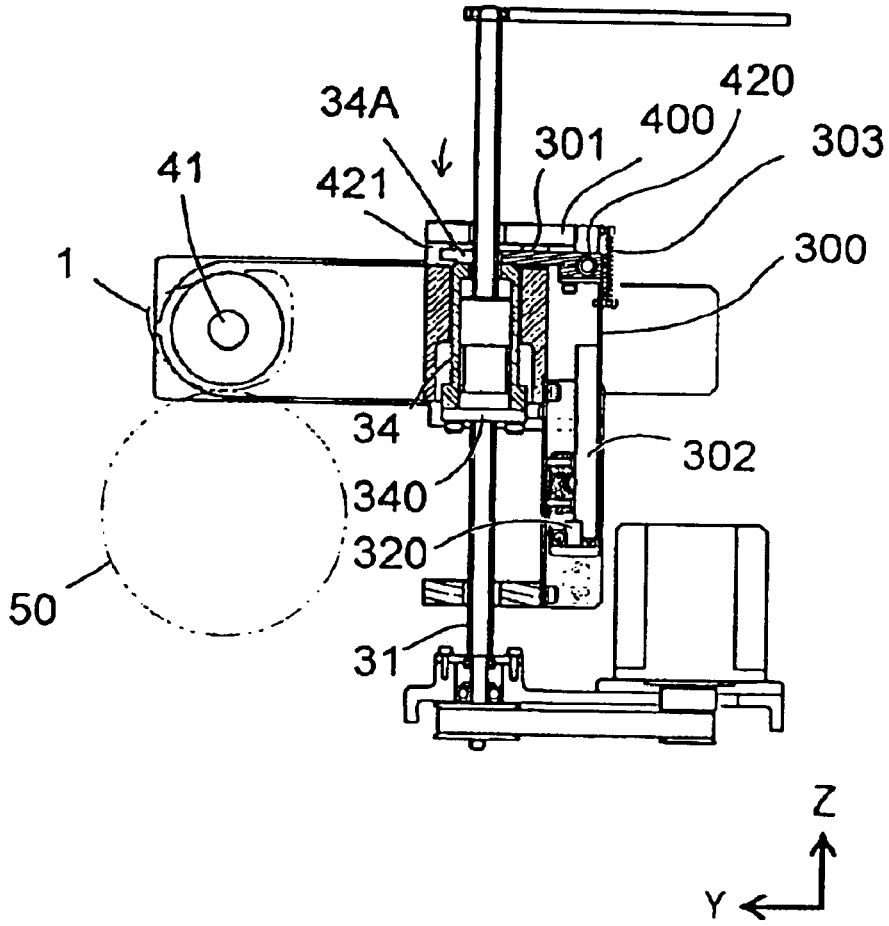
FIG. 7 shows a sectional view of the elevating and lowering unit and the lens unit in the vertical direction when the processing is completed.

When the stopper 36 is not in contact with the ceiling portion 400, the lens 1 supported by the lens unit 4 is brought into contact with the main rotating tool 50, as shown in FIG. 7, and the weight of the lens unit 4 itself is applied as the processing pressure. The upper end face 34A of the positioning member 34 and the lower face of the ceiling portion 400 are not in contact with each other. Consequently, a prescribed gap is formed between the upper end face 34A of the positioning member 34 and the lower face of the ceiling portion 400.

At a position below the ceiling portion 400 and facing the gap, a hole portion 421 is provided in frame 40. A sensor arm 300 for detecting completion of the processing on the lens unit, in the vertical direction, is also provided. An end of the sensor arm 300 is inserted into the hole portion 421 and is disposed along the Y-axis, as shown in FIG. 7, in a manner such that the hole portion 421 penetrates the frame 40 across the hole portion 40A. In other words, hole portion 421 and hole portion 40A are contiguous.

The sensor arm 300, as shown in FIGS. 6 and 7, is an integrally formed arm having the shape of an inverse L, which is composed of an arm 301 extending to the left side in the Figures (in the direction of the Y-axis) and that inserts into the hole portion 421, and an arm 302 extending in the lower direction in the Figure (in the direction of the Z-axis, to the side of the base 20). The arm 301 and the arm 302 are disposed approximately perpendicularly to each other. The length of the arm 302 in the vertical direction is set longer than that of the arm 30' in the horizontal direction.

A bending portion 303, located at the middle of the sensor arm 300 having the shape of an inverse L, is supported by a shaft 420 disposed by the ceiling portion 400 of the lens unit 4 in a manner so that the bending portion 303 can freely swing around the shaft 420. Therefore, the sensor arm 300 can swing around the X-axis.

Between the arm 302 extending in the direction of the Z-axis and the ceiling portion 400, a spring 310 is disposed, which pushes or biases the arm 301 that extends in the direction of the Y-axis to rotate towards the lower direction in FIGS. 6 and 7 (i.e., to rotate in the counter-clockwise direction about shaft 420 shown in the Figures).

Since the arm 301 inserts into the hole portion 421 and crosses the hole portion 40A in the direction of the Y-axis, arm 301 is constructed to include a penetrating portion through which the screw 31 inserts. Furthermore, arm 301 is constructed so that the lower face of the arm 301 faces towards the inner periphery of the hole portion 40A so that the lower face of the arm 301 can be brought into contact with, or separated from, the upper end face 34A of the positioning member 34.

Since the sensor arm 300 is pushed in the counter-clockwise direction, as is evident in FIG. 6, by the spring 310, the tip 301A of the arm 301 is brought into contact with the lower side of the hole portion 421 and stops there when the upper end face 34A of the positioning member 34 and the arm 301 are separated from each other (this condition occurs whenever the stopper 36 is separated from the ceiling portion 400).

On the other hand, as shown in FIG. 7, when the stopper 36 of the positioning member 34 contacts the ceiling portion 400 of the lens unit 4, the positioning member 34 supports the lens unit 4, and the upper end face 34A of the positioning member 34 pushes the arm 301 in the upper direction (i.e., clockwise). In other words, when stopper 36 contacts ceiling portion 400, the positioning member 34 contacts the arm 301 and pushes the arm in the clockwise direction about shaft 420. When this occurs, the sensor arm 300 rotates and the arm 302 extending in the direction of the Z-axis is placed at the prescribed position (for example, a position in the vertical direction).

Attached to frame 40, there is a bracket 422 disposed and constructed to protrude along the lower portion of the sensor arm (i.e., along the arm 302). At a prescribed position on the bracket 422, which can face the lower end side of the arm 302 that swings around the X-axis, a sensor 320 is disposed. Sensor 320 is for detecting completion of the processing by detecting the approach of the arm 302 as it swings around the X-axis. The sensor 320 for detecting completion of the processing is constructed to include a photosensor, such as a photointerruptor. Sensor 320 is set in a manner, as shown in FIG. 7, such that the sensor is switched to ON when the swinging arm 302 comes to the prescribed position (also referred to as the position in the vertical direction" or "the position of detecting the arm").

The distance L2 from the shaft 420, which provides an "axis of swing," or pivot axis, to the position of the sensor 320 for detecting completion of the processing (i.e., the position of detecting the arm 302 illustrated in FIG. 6) is set to be longer than the distance L1, where L1 is the distance from the shaft 420 to the position where the arm 301 is brought into contact with the upper end face 34A of the positioning member 34 (refer to FIG. 6). The amount of displacement of the arm 301, which is used to detect the relative displacement between the lens unit 4 and the positioning member 34, is amplified in accordance with the ratio of L2 to L1 (hereinafter, referred to as the lever ratio; L2/L1)

so that the lower end of the arm 302 is displaced by the amplified amount. In other words, for any amount of displacement of arm 301, there is a corresponding displacement of arm 302 that is equal to the lever ratio times the amount of displacement of arm 301.

As described above, the weight of the lens unit 4 provides the processing pressure for the lens 1. The lens unit 4 is guided to move along poles 401 and 402 in a manner such that displacement of the lens unit 4 can be made in the vertical direction. As evident from FIG. 6, when the positioning member 34 is lowered and leaves the lens unit 4 to move in the lower direction, the lens 1 is brought into contact with the main rotating tool 50. The weight of the lens unit 4 is added to the weight of the lens and grinding starts.

When the screw 31 is rotated to lower and place the positioning member 34 at the position providing the prescribed processing depth, as shown in FIG. 6, a gap is formed between the upper end face 34A of the positioning member 34 and the lower face of the arm 301. Simultaneously, the axis of the lens 1 slowly approaches the main rotating tool 50 so that the lens 1 is eventually ground under the weight of the lens unit 4. When this condition occurs, the sensor arm 300 is pushed in the counter-clockwise direction and the arm 301 is stopped at the lower face of the hole portion 421. The lower end of the arm 302 is placed at a position separated from the sensor 320 for detecting completion of the processing. Consequently, the output of the sensor 320 for detecting completion of the processing is indicated as OFF because arm 302 is separated from the detection range of the sensor 320.

As the grinding proceeds and the lens 1 is ground to the prescribed depth as shown in FIG. 7, the upper end face 34A of the positioning member 34 pushes the arm 301 in the upper direction (i.e. clockwise) and the sensor arm 300 is rotated in the clockwise direction. Consequently, arm 302 passes through the sensor 320 for detecting completion of the processing and the sensor 320 is switched to ON.

As described above, because the swing of the arm 302 is amplified by the lever ratio compared to the swing in the arm 301, the difference in the position of the lens unit 4 in the vertical direction and the position of the positioning member 34 in the vertical direction (i.e., the processing depth) is amplified by the lever ratio. As a result, the processing depth is detected with a great accuracy by the sensor 320 for detecting completion of the processing, which is important for detecting when the prescribed processing depth has been achieved.

The elevating and lowering unit 3 supports the lens unit 4 in the elevating direction. After the lens unit 4 starts the processing of the lens 1, the processing depth (also referred to as the "processing amount") is decided in accordance with the position of the elevating and lowering unit 3 in the direction of the Z-axis.

The Lens Unit

The lens unit 4 that is displaced by the elevating and lowering unit 3 in the direction of the Z-axis, as shown in FIG. 2, is guided by the two poles 401 and 402 standing on the base 20 in the vertical direction (i.e., in the direction of the Z-axis) in a manner such that the lens unit 4 can be freely displaced. Lens unit 4 is constructed to include the lens-holding shaft 41, which is divided into two portions 41R and 41L, a motor 45 (see FIG. 8) for driving the lens 1 that rotates the lens-holding shaft 41, and a motor 46 (see FIG. 8) for the lens chuck that changes the holding pressure of the two portions of the lens-holding shaft that hold the lens 1.

As shown in FIGS. 4 and 5, lens-holding shaft 41 holds and rotates the lens 1 and is placed at a position directly above the main rotating tool 50. The vertical direction connects the axial line of the lens-holding shaft 41 and the axial line of the main shaft 51.

Connected to the frame 40 of the lens unit 4, as shown in FIGS. 2 and 8, are arms 410 and 411 disposed to protrude in the direction towards the front of the apparatus (i.e., to the lower left side of FIG. 2). Frame 40 and the arms 410 and 411 form a rectangle having three sides that is open to one side (i.e., "C"-shaped). The arms 410 and 411 support the lens-holding shaft 41.

As shown in FIGS. 3 and 8, the lens-holding shaft 41 is divided at its center into two shaft portions 41R, 41L, which are a shaft 41R supported by the arm 410 and the shaft 41L supported by the arm 411. Shaft 41L is supported by the arm 411 at the left side, as shown in FIG. 8, in a manner that allows the shaft 41L to freely rotate. Shaft 41R is supported by the arm 410 at the right side, as shown in FIG. 8, in a manner that allows the shaft 41R to freely rotate and that allows shaft 41R to be displaced in the axial direction (i.e., in the direction of the X-axis). Shaft 41R may be referred to as the "pushing shaft."

The shafts 41L and 41R are rotated by the motor 45 for driving the lens via cogged belts 47, 48 and 49. The cogged belts 47 and 48 are connected to each other through a rotatable shaft 430 so that the angles of rotation of the shafts 41L and 41R are synchronized.

To achieve this synchronization, a gear 432 is engaged with the cogged belt 47 and is fixed to the shaft 41L, and a gear 431 is engaged with the cogged belt 48 and is fixed to the shaft 41R. So that the shaft 41R can be axially displaced, relative to the arm 410, in the direction of the X-axis, the shaft 41R is arrested in the direction of rotation by the key 433 disposed between the shaft 41R and the inner periphery of the gear 431. Key 433 can be relatively displaced in the direction of the X-axis, which pulls shaft 41R along with it when displaced in the direction of the X-axis.

As shown in FIG. 8, a chuck mechanism driven by a motor 46 for the lens chuck is disposed at the end portion (i.e., at the right side in the Figure) of the shaft 41R.

Figure 9:
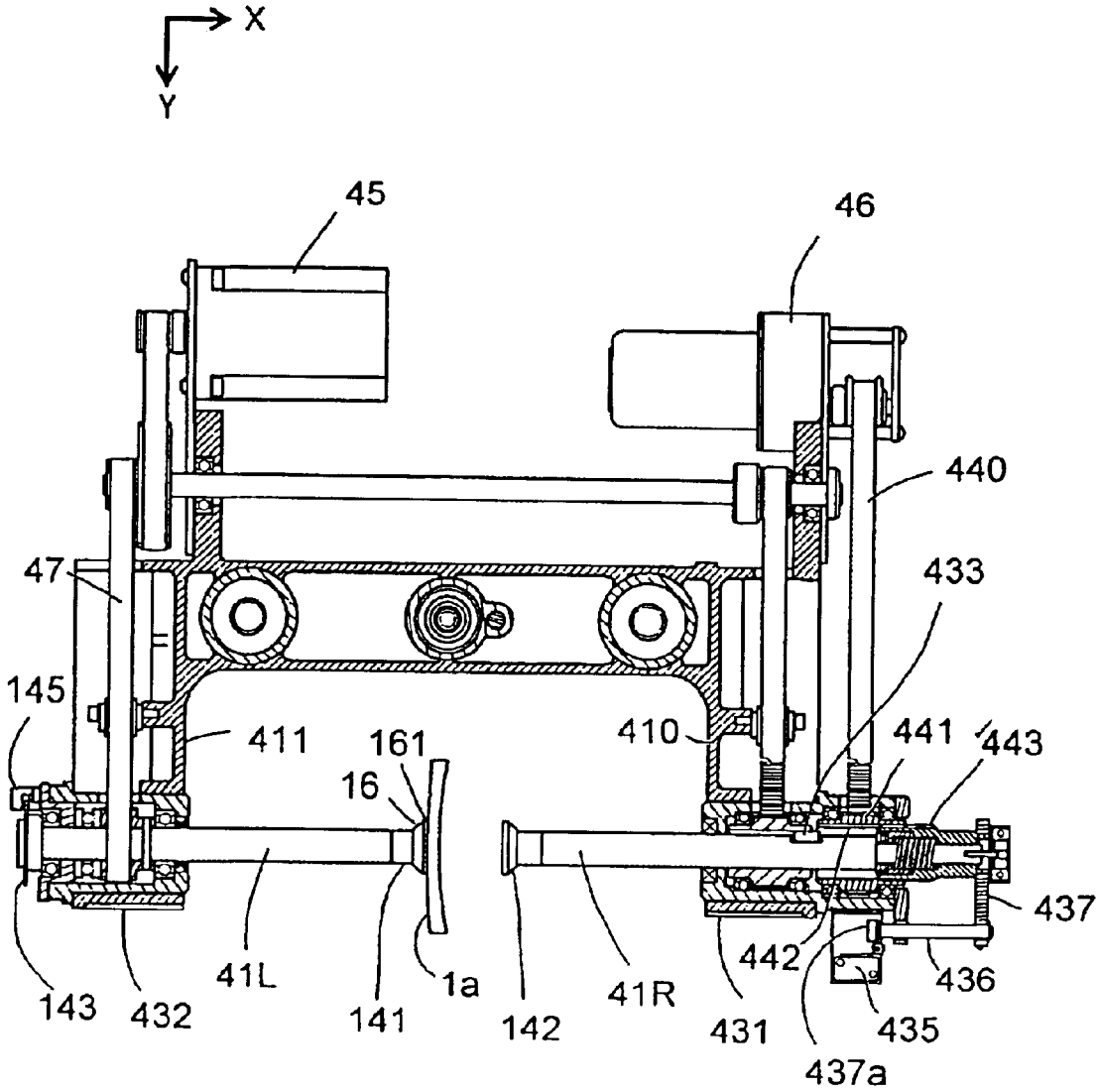
FIG. 9 shows a sectional view of the elevating and lowering unit and the lens unit in the horizontal direction in the condition that the lens is released from the lens-holding shaft.

In the chuck mechanism as shown in FIG. 9, an outer screw 442 is formed at the inner periphery of a gear 441 engaged with the cogged belt 440. The outer screw 442 is engaged with an inner screw portion 443 formed at a driving member 461 (see FIG. 20), which can be brought into contact with the shaft 41R in the axial direction.

The position of rotation of the shaft 41R is decided by the motor 45 for driving the lens that is connected to the cogged belt 48. As for determining the position of the shaft 41R in the axial direction, as will be described later, gear 441 is rotated by the rotation of the motor 46 for the lens chuck, which causes the inner screw portion 443 of the driving member 461 engaged with the outer screw 442 to be displaced in the axial direction. Due to this axial displacement, the shaft 41R is pushed in the direction of the X-axis by the driving member 461 and the end portion of the shaft 41R is brought into contact with the lens 1 as shown in FIG. 8. The pressure with which the shaft 41R and the shaft 41L hold the lens 1 is called the "holding pressure," and can be set at a desired value by the motor 46 for the lens chuck. In the present embodiment, the holding pressure for the lens 1 is set by the value of the electric current driving the motor 46 for the lens chuck. Therefore, control of the electric current controls the motor 46 thereby setting the value of the holding pressure.

In FIG. 9, a receiver 141 of the lens holder is fixed at the tip of the left shaft 41L of the lens-holding shaft 41. To the receiver 141 of the lens holder, a lens holder 16 attaches.

Prior to attaching lens holder 16 to the receiver 141, a lens 1 to be processed is fixed in advance to the lens holder 16. The lens holder 16 can be attached or released freely from receiver 141 and from lens 1.

On the other hand, the shaft 41R, disposed on the same axial line as that of the shaft 41L, moves in the direction of the X-axis and holds the lens at the tip. In other words, the shaft 41R moves towards the lens 1 by being driven by the motor 46 for the lens chuck and presses the lens 1 with a lens presser 142 disposed at the tip of shaft 41R. The lens 1 is pressed towards the lens-holding shaft 41L and held between the two shafts 41R, 41L by the holding pressure generated by motor 46. The lens presser 142 is made of a resin, such as rubber, having elasticity so as to prevent damage to the lens 1.

At the end face of the lens holder 16, which is formed into a concave shape, the convex face 1*a* of the lens 1 is coaxially adhered via a double faced adhesive pad 161 and the lens presser 142 presses the concave face 1*b* of the lens 1. The lens presser 142 is attached to the tip of the shaft 41R so as to hold the lens 1 in a manner whereby the lens presser can be swung in any desired direction and the concave face 1*b* of the lens 1 is still pressed with excellent balance without any adverse local concentration of pressure on the lens.

As evident from FIG. 9, which illustrates the starting condition wherein lens 1 is fixed to the lens holder 16 attached to the shaft 41L, the lens 1 is held by the lens presser 142 in the following manner: (a) the motor 46 for the lens chuck is driven in the prescribed direction (i.e., the positive rotation); (b) the gear 441 is rotated in the positive direction due to this movement of the motor 46; and (c) the shaft 41R is displaced towards the left side of FIG. 9 by the relative rotation of the outer screw 442 at the inner periphery of the gear 441 and the inner screw portion 443 of the shaft 41R.

The mechanism of the lens chuck, which holds the lens 1 under pressure, will be described with reference to FIG. 20.

The base end of the shaft 41R is opposite the tip having the lens presser 142 attached thereto, and is engaged in the rotating direction with the inner periphery of the gear 431. Gear 431 is driven by the motor 45 for driving the lens via key 443 and a key groove, wherein the shaft 41R is supported in a manner so that the shaft 41R can be displaced in the axial direction of the X-axis relative to the gear 431.

Figure 20:
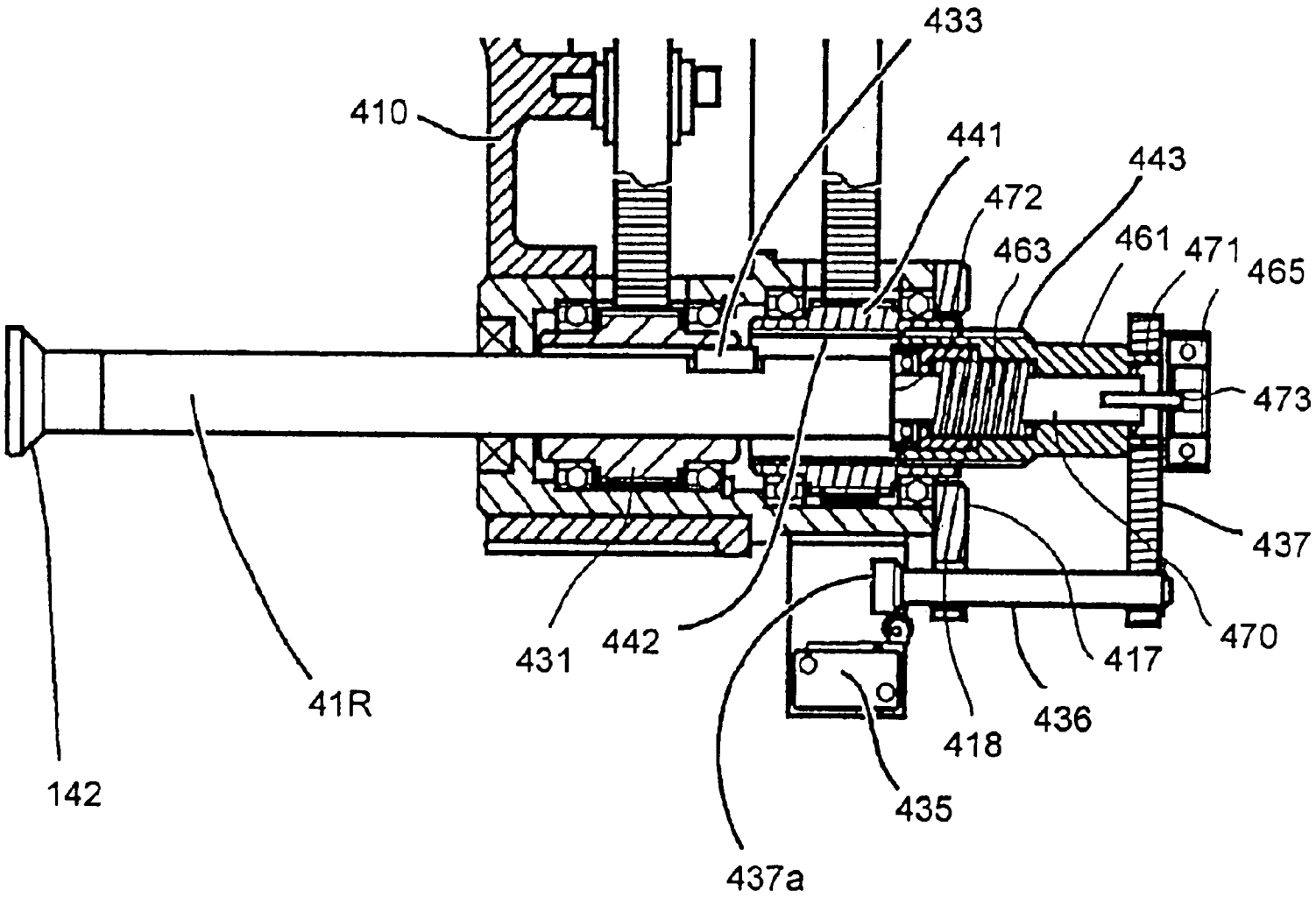
FIG. 20 shows an expanded view of the chuck mechanism in a section of the lens unit in the horizontal direction.

At the right side of the gear 431 in FIG. 20, the gear 441 driven by the motor 46 for the lens chuck is disposed on the arm 410 in a manner such that gear 441 can be rotated around a shaft. At the inner periphery of the gear 441, the outer screw 442 (refer to FIG. 9) is formed and a cylindrical driving member 461 is engaged with the outer screw 442 via an inner screw 443 formed on the outer periphery of the cylindrical driving member 461.

The inner periphery of the driving member 461 engages a thin shaft portion 470, wherein the thin shaft portion 470 has a small diameter and is disposed at the right end portion of the shaft 41R. Shaft portion 470 protrudes to the right side as shown in the FIG. 20. The shaft portion 470 penetrates the inner periphery of the driving member 461 at the right side in FIG. 20 so that the relative displacement of the shaft portion towards the right side of FIG. 20 is restricted by a snap ring 471 disposed at the outer periphery of the tip.

The thin shaft portion 470 is formed in the shaft 41R and has a smaller diameter than that of the main shaft portion. The driving member 461 is brought into contact with a step portion 472 of shaft 41R, which demarcates the thin shaft portion 470 from the main portion, when the driving member 461 moves towards the left side in FIG. 9 (i.e., towards the lens 1) thereby driving the shaft 41R towards the lens 1.

When the driving member 461 moves towards the right side in the FIG. 9 (i.e., away from the lens 1), the shaft portion 470 and the main portion of shaft 41R are arrested by the snap ring 471 as they move to the right side in FIG. 9. Thus, the shaft 41R is driven in accordance with the displacement of the driving member 461 in the axial direction.

At the inner periphery of the driving member 461, a spring 463 is attached to the shaft 41R to push it towards the lens 1 so that the lens is temporarily held by the force of the spring 463. In other words, in the "lens released condition" shown in FIGS. 20 and 9, wherein the lens is released, the shaft 41R and its shaft portion 470 can be displaced in the axial direction, relative to the driving member 461, within a very small range. However, the shaft 41R is pushed by the spring 463 and protrudes from the gear 431 by the prescribed distance.

When the driving member 461 is displaced towards the left side as shown in FIG. 8, the lens presser 142 is brought into contact with the lens 1 and the leftward displacement of the shaft 41R and the shaft portion 470 in the axial direction stops. The spring 463 is compressed between the step portion 472 and the driving member 461 so that the spring generates a temporary holding pressure that is applied to the lens 1. The condition illustrated in FIG. 8 is the "lens holding condition."

When the driving member 461 is further displaced towards the left side in FIG. 8, the driving member 461 is brought into physical contact with the step portion 472 and the shaft 41R is brought to a position wherein the shaft 41R is directly pushed by the driving member 461. Consequently, the lens 1 is held between the shaft 41R and the shaft 41L under the prescribed temporary holding pressure formed in accordance with the amount of compression of the spring 463.

To detect the position corresponding to the temporary holding pressure (i.e., the lens holding condition), also referred to as the "temporary holding position," a sensor rod 473 is disposed at the tip of the shaft portion 470 and protrudes in the axial direction. The sensor rod 473 is inserted into the inner periphery of a plate 437 disposed at the tip of the driving member 461 and into the inner periphery of a photosensor 465 disposed by the plate 437. Because the tip of the sensor rod 473 is inserted into a prescribed position in the photosensor 465, the photosensor 465 can detect when the driving member 461 is at the temporary holding position, which is reached when the compression of the spring 463 is completed.

When the driving member 461 is displaced further towards the left side in FIG. 8 from the temporary holding position, the shaft 41R deforms the lens presser 142, which is made of an elastic material, through pressure applied to the step portion 472 so as to increase the lens holding pressure applied to the lens 1. The photosensor 465 is constructed to include a photointerruptor or the like.

One skilled in the art would realize that when the driving member 461 is displaced towards the left side in FIG. 8 as described above, first, the lens 1 is temporarily held by the pressure generated by the compression of the spring 463, and then the driving member 461 directly pushes on the shaft 41R to increase the lens holding pressure. On the other hand, when the driving member 461 is displaced to the right side as shown in FIG. 9, the shaft 41R is drawn to the right side in the Figure through the snap ring 471 disposed at the outer periphery of the tip of the shaft portion 470 until displaced to the prescribed waiting position (i.e., the position illustrated in FIG. 9).

The driving member 461 is engaged with the outer screw 442 at the inner periphery of the gear 441 only through the inner screw 443 at the outer periphery of the driving member 461, and the rotation is restricted by a plate 437 disposed at the end portion of the driving member 461.

In other words, plate 437 extends from the end portion of the driving member 461 in the direction of Y-axis and, at the tip of the plate 437, a sliding member 436, having a rod shape and protruding towards the lens 1, is securely fixed in the direction of the X-axis to the plate 437.

The sliding member 436 is a rod having a portion that is engaged with a penetrating hole 418 disposed in a plate 417 for restricting rotation that is fixed at the arm 410. Due to the contact of the penetrating hole 418 with the sliding member 436, which is located near the shaft of the driving member 461, the rotation of the driving member 461 is prevented by the sliding member 436. Therefore, the driving member 461 is engaged with the outer screw 442 of the gear 441 and the driving member can be displaced in the direction of the X-axis alone to drive the shaft 41R as desired in accordance with the positive or negative rotation of the motor 46 for the lens chuck. Because of the engagement of sliding member 436 with plate 417, the driving member 461 does not rotate.

When the motor 46 for the lens chuck is further rotated from the temporary holding position, the force for pressing the lens increases and the electric current consumed by the motor 46 for the lens chuck increases. The lens holding pressure holding the lens is set at a desired value by detecting the electric current.

On the other hand, when the processing is completed, the motor 46 for the lens chuck is rotated in the reverse direction and the shaft 41R is driven towards the right side in FIG. 8. The lens presser 142 is separated from the lens 1 and a prescribed gap is formed between the lens 1 and the lens presser 142 as shown in FIG. 9. The shaft 41R is displaced to the waiting position, which allows attachment and detachment of the lens 1 and the lens holder 16 from the receiver 141.

Since the shaft 41R of the lens-holding shaft 41 is displaceable in the axial direction of the X-axis, it is necessary to have a mechanism that can determine the position of the shaft 41R. When the shaft 41R moves towards the lens 1, the position of shaft 41R is found by monitoring the electric current of the motor 46 for the lens chuck to determine whether the lens-holding shaft 41 contacts the lens 1. However, when the shaft 41R moves to the right side towards the waiting position shown in FIG. 9, the prescribed waiting position is detected by a limit switch 435 disposed close to the arm 410 of the lens unit 4.

In FIGS. 9 and 20, the limit switch 435 is shown fixed to the arm 410 at the position supporting the gear 441.

At the end portion of the sliding member 436 that restricts the rotation of the driving member 461, there is constructed a detecting portion 437*a*, which can contact the limit switch 435 at the prescribed waiting position.

When the shaft 41R moves towards the right side in FIGS. 9 and 20, the sliding member 436 fixed to the shaft 41R also moves to the right side. As shown in FIG. 9, the position where the detecting portion 437*a* contacts the limit switch 435 corresponds to the waiting position of the shaft 41R, so the limit switch 435 is switched to ON at this position.

Then, as shown in FIG. 19, the processing depth is decided in accordance with the rotation angle of the lens 1. To determine the processing depth, shaft 41L is constructed to penetrate the arm 411 and a slit plate 143 (see FIG. 9) that is fixed at the end portion of shaft 41L protruding from the arm 411. By detecting the position of rotation of the slit plate 143 using a photosensor 145 (i.e., a lens position sensor; also referred to as "a means for detecting the angle") fixed to the arm 411, the position (i.e., the rotation angle) of the lens 1 held by the lens-holding shaft 41L is detected (i.e., measured).

In the lens unit 4 having the construction described above, when the lens 1 is fixed at the receiver 141 of the lens holder, the motor 46 for the lens chuck is driven and the lens-holding shaft 41R is moved towards the left side of FIG. 9. The lens 1 is then held, or fixed under pressure, when the lens presser 142 presses against the lens 1.

During lens processing of lens 1 and during measurement of the position of the complete processing on the periphery of the lens, the lens-holding shafts 41L and 41R are rotated by driving the motor 45 for driving the lens which causes the lens 1 to be rotated as well.

As evident from FIG. 3, the main rotating tool 50 is fixed to the base plate 15 and is not displaced. The lens 1 supported by the lens unit 4 is displaced in the vertical direction relative to the main rotating tool 50 by the displacement of the elevating and lowering unit 3 in the direction of the Z-axis so that processing can be conducted to the desired depth.

The position of the lens 1 for processing can be changed by changing the rotation angle of the motor 46 for driving the lens so that the peripheral portion of the lens can be processed to the desired processing depth.

The tool used for processing can be changed by changing the position of contact between the lens 1 and the main rotating tool 50 by adjusting the displacement of the base 20 in the direction of the X-axis. In other words, by moving the base 20 in the direction of the X-axis, one of the grinders 50*a*, 50*b*, 50*c*, and 50*d* can be selected for use in processing.

Unit for Controlling the Processing Pressure

The unit 8 for controlling the processing pressure, which is a unit for adjusting the load, will be described. Unit 8 for controlling the processing pressure controls the pressing pressure of the lens 1 supported by the lens unit 4 as it presses against the main rotating tool 50.

The unit 8 for controlling the processing pressure, as shown in FIG. 5, is fixed on an upper base 200, which is disposed at upper ends of poles 401 to 404 that stand on the base plate 2, and is displaced in the direction of the X-axis in combination with the lens unit 4. In other words, unit 8 moves along with lens unit 4.

In FIG. 5, the unit 8 for controlling the processing pressure is constructed with pulleys 82 driven by a motor 81 for controlling the processing pressure (also called "an actuator"), wires 83 wound around the pulleys 82 and springs (also called an "elastic member") 84 connecting the wires 83 to the frame 40 of the lens unit 4, as the main components. The motor 81 for controlling the processing pressure and the pulleys 82 are connected to each other via a worm gear 87.

As shown in FIG. 5, the lens unit 4 is suspended with pairs of pulleys 82 (also called "winding members"), corresponding wires 83 (also called "suspending members") and the springs 84. The numbers of wires 83 and springs 84 can be selected as desired.

The force pressing the lens 1 to the main rotating tool is referred to as the "processing pressure" or the "grinding pressure," and is the weight of the lens unit 4 itself. However, it is necessary to change the processing pressure, which is a surface pressure, in accordance with the material (i.e., glass or resin) of the lens undergoing processing and the thickness of the peripheral portion of the lens. In order to provide a mechanism that allows for adjusting the processing pressure, a portion of the weight of the lens unit 4 is supported by the tension of the springs 84 so that the load of the lens unit 4 applied to the lens 1 can be adjusted.

Because the lens 1 is processed while the lens unit 4 is displaced vertically, it is necessary that an approximately constant processing pressure be applied independently of the position of the lens unit 4.

Therefore, so that the tension of the springs 84 is held approximately constant the amount of unwinding of the wires 83 is adjusted by the motor 81 for controlling the processing pressure in accordance with the displacement of the lens unit 4 in the direction of the Z-axis.

As evident from FIG. 5, the amount of unwinding of the wires 83 is controlled in accordance with the rotation angle and the number of rotations of the pulleys 82. The rotation angle and the number of pulley rotations of pulleys 82 are detected using slit plate 85 disposed coaxially with the pulleys 82 and a photosensor 86 that detects the passage of the slit.

To determine the position of the lens unit 4 in the direction of the Z-axis, the amount of driving of the Z-axis motor 42 (for example, the output of the encoder in the case of a servomotor and the number of steps in the case of a step motor), or a value obtained by directly measuring the position of the lens unit 4, or a value obtained by directly measuring the position of the lens-holding shaft 41 along the Z-axis, can be used.

One skilled in the art would recognize that there is a relation between the amount of unwinding of the wires 83 (or the amount of driving of the motor 81 for controlling the processing pressure) and the processing pressure applied to the lens 1. Specifically, the tension of the springs 84 decreases and the processing pressure increases as the amount of unwinding of the wires 83 increases, and the tension of the springs 84 increases and the processing pressure decreases as the amount of unwinding of the wires 83 decreases.

Figure 10:
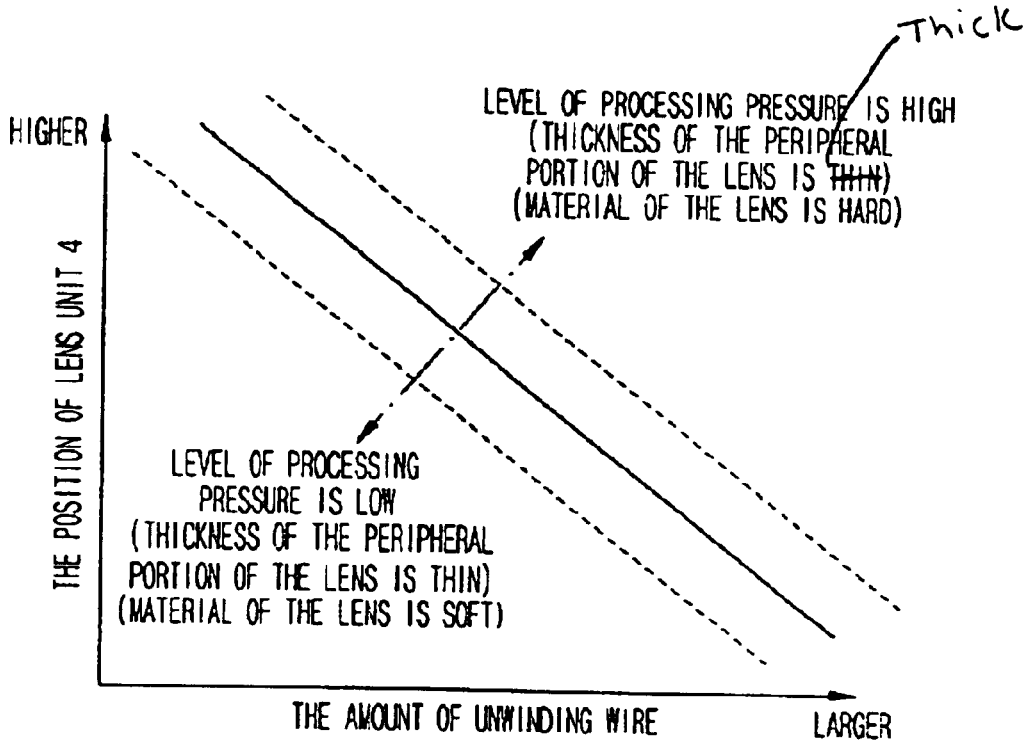
FIG. 10 is a graph describing the relation between the amount of unwinding of the wire and the position of the lens unit using the processing pressure as a varied parameter.

One skilled in the art would also recognize that there is a relation between the position of the lens unit 4 in the direction of the Z-axis and the amount of unwinding of the wires 83. Specifically, the amount of unwinding can be decreased as the lens unit 4 is elevated to a higher position and the amount of unwinding of the wires 83 can be increased as the processing by the lens unit 4 proceeds using a linear table or the map (i.e., graph) such as shown in FIG. 10.

Since the required processing pressure varies depending on the material of the lens 1 and the thickness of the peripheral portion of the lens 1 as described above, as will be described later, the processing pressure can be selected based on a plurality of properties shown in FIG. 10 based on information in the form of material input and the thickness of the peripheral portion. Alternatively, the relation between the amount of unwinding and the position of the lens unit 4 (i.e., a proportional relation) is obtained by calculation.

Because the thickness of the peripheral portion varies depending on the position of processing, the selected property may change in accordance with the rotation angle of the lens-holding shaft 41 (i.e., the position of processing the lens).

The position of the lens unit 4 in the direction of the Z-axis is decided by the elevating and lowering unit 3 described above. As shown in FIG. 19, because lens processing is conducted while the lens 1, supported by the lens-holding shaft 41, is rotated, the position in the direction of the Z-axis always changes. As evident from FIGS. 6 and 7, the position of the lens unit 4 at the start of the processing is different from the position of the lens unit 4 at the end by the difference equal to the processing depth.

When the amount of unwinding of the wires 83 is controlled in accordance with the change in the rotation angle of the lens 1, or the processing depth, the electronic control and the physical mechanism become complicated due to the detection of the actual processing position.

By disposing springs 84 between the wires 83 and the frame 40 of the lens unit 4, the processing pressure close to the set value can be maintained by change in the length of the springs 84 even when the amount of unwinding of the wires 83 cannot follow the change in the position of the lens unit 4. Therefore, the calculation load required for the control can be decreased remarkably.

The Measuring Unit

As shown in FIGS. 3, 4 and 11, a measuring unit 6 comprises a pair of styluses 60 and 61 as its main components, and is disposed directly above the lens-holding shaft 41. The measuring unit 6 is fixed to an upper portion of a tool frame 53.

The pair of styluses 60 and 61 can be displaced solely in the direction of the X-axis although the styluses 60 and 61 are located directly above (i.e., on the vertical line of the lens-holding shaft 41. Attached to the styluses 60 and 61 are linear scales 600 and 601, respectively, for detecting the displacements of the styluses in the direction of the X-axis. The styluses 60 and 61 can be moved by the motor 62 for driving the styluses from the "waiting positions" shown in FIG. 3 by moving the styluses in the directions which bring both styluses 60 and 61 into contact with each other.

When the "finishing position" of the peripheral portion of the lens 1 (or the thickness of the peripheral portion) is measured, the lens unit 4 is elevated to the prescribed upper position based on the data describing the shape of the lens frame. Then, the pair of styluses 60 and 61 are brought into contact with the lens 1 by driving the motor 62 for driving the styluses.

Thereafter, the lens unit 4 is elevated or lowered based on the data describing the shape of the lens frame while the lens-holding shaft 41 is rotated, and the values detected by the linear scales 600 and 601 at every rotation angle are read. In this manner, the position of the peripheral portion of the lens is measured by tracing the locus of the peripheral portion of the lens obtained after the lens is finished (i.e., the processing is completed). In accordance with the present invention, the position of the peripheral portion of the lens is measured in the three-dimensional coordinate including: (a) the rotation angle of the lens, (b) the position in the direction of the X-axis and (c) the position in the direction of the Z-axis. In this measurement, the value detected by the linear scale is used as the position in the direction of the X-axis, and the amount of driving by the Z-axis motor 33, or the position of the lens unit 4, is used as the position in the direction of the Z-axis. As described above, the rotation angle of the lens 1 is measured using the slit plate 143 and photosensor 145.

As shown in FIG. 11, the measuring unit 6 is attached to a frame 63 having the shape of a rectangle, having three sides but open in the downward direction (i.e., to the side of the main shaft 51). Measuring unit 6 is fixed on the tool frame 53 shown in FIG. 3.

To the right and left sides of the frame 63, in the front view of the apparatus corresponding to FIG. 3, wall portions 631 and 632 are disposed and stand in the direction of the Y-axis as evident from FIG. 11. Between the right and left wall 631 and 632, a guide shaft 64 is fixed in the direction of the X-axis. Moving members 610 and 611 have the styluses 60 and 61, respectively, attached so as to protrude in the downward direction. Moving members 610 and 611 are engaged with the guide shaft 64 and are guided in the direction of the X axis in a manner such that the moving members 610 and 611 are displaced freely.

On the wall portions 631 and 632, a shaft 65 is fixed parallel with the guide shaft 64. The moving members 610 and 611 are engaged also with the shaft 65 so that the moving members are restricted in their movement so as to not freely rotate around the X-axis.

On the upper portion 63*a* of the frame 63, a pair of pulleys 66 and 67 are disposed around each shaft in the direction of the Y-axis. The pulley 67 is driven by the motor 62 for driving the stylus. A wire 68 is placed between the pulleys 66 and 67 in an elliptical shape and rotated along the line of the ellipse by the driving the motor 62 for driving the stylus.

Figure 12:
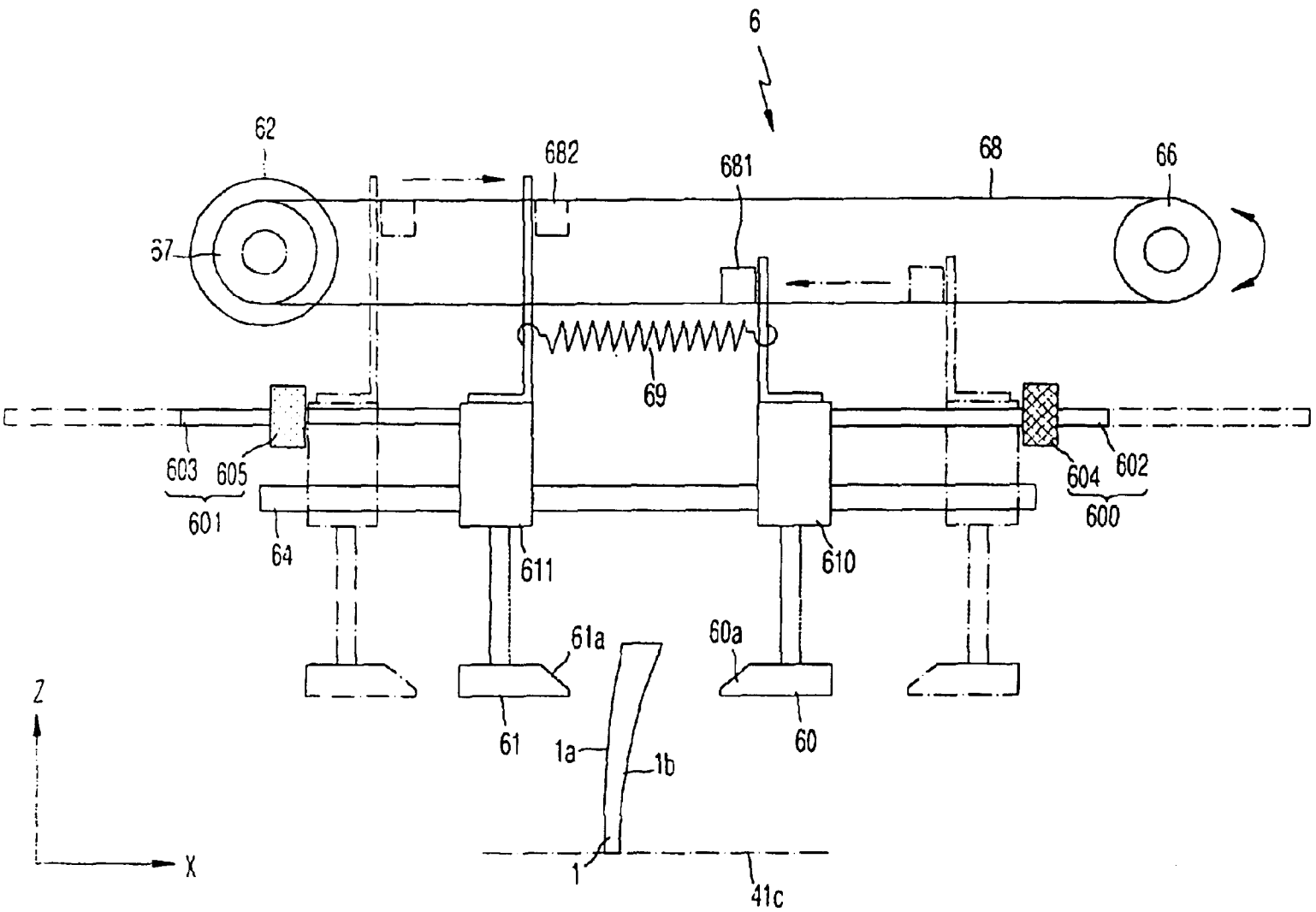
FIG. 12 shows a schematic diagram of the measuring unit.

As shown in FIGS. 11 and 12, a stopping member 681 for restricting the displacement of the moving member 610 to the left side in the Figures is fixed at a lower position of the wire 68, and a stopping member 682 restricting the movement of the moving member 611 to the right side in the Figures is fixed at an upper position of the wire 68. A spring 69 which pulls the moving members 610 and 611 towards each other is disposed between the moving members 610 and 611, and the moving members 610 and 611 are always pulled by the spring 69 so as to bias the moving members to come closer to each other.

Therefore, as shown in FIG. 12, when the motor 62 for driving the stylus is driven in a manner such that the wire 68 is rotated along the ellipse in the clockwise direction, the stopping member 681 moves to the left side and the stopping member 682 moves to the right side in the Figure. When the stopping members 681 and 682 approach each other, the styluses 60 and 61 can be brought into contact with each other as a result of moving freely in the direction of the X-axis.

When the lens unit 4 is kept at an elevated position at this time, the stylus 60 will contact the concave face 1*b* and the stylus 61 will contact the convex face 1*a* of the lens 1. In this manner, the styluses 60 and 61 can be displaced in the direction of the X-axis in accordance with the shape of the lens 1 without restriction on the displacement in the direction of the X-axis by the stopping members 681 and 682.

By elevating and lowering the lens unit 4 in accordance with the shape of the lens frame while the lens-holding shaft 41 is rotated by one revolution, the styluses 60 and 61 can trace the locus of finishing on both faces of the lens 1, and the finishing position of the peripheral portion of the lens 1 can be measured by the linear scales 600, 601 in one revolution.

When these measurements are completed, the motor 62 for driving the stylus 62 is driven to rotate the wire 68 along the ellipse in the counter-clockwise direction, which results in displacing the moving members 610 and 611 in directions so that the moving members are separated from each other due to the separation of the stopping members 681 and 682, respectively. The moving members are displaced to the waiting positions shown by the phantom lines in FIG. 12. Consequently, the styluses 60 and 61 are moved to the waiting position so that the styluses 60 and 61 do not disturb the process of chamfering and grooving performed by the finishing unit 7, which will be described later.

As shown in FIGS. 11 and 12, the linear scales 600 and 601, which measure the positions of the styluses 60 and 61 in the direction of the X-axis, are constructed to include sensor units, such as sensor units of the magnetic strain type. Sensor rods 602 and 603 are fixed to the moving members 610 and 611 so as to be oriented in the direction of the X-axis. Probes 604 and 605, penetrating the sensor rods 602 and 603, are fixed to the frame 63. The outputs from the probes 604 and 605 are inputted into the control portion 9, which will be described later.

The styluses contact the upper half portions of the lens 1 (i.e., the portions above the axial line 41*c* of the lens-holding shaft as shown in FIG. 12). The styluses are constructed to have a shape wherein the end portions facing towards the lens 1 have a wedge shape with inclined portions 60*a* and 61*a* located on the upper face. In particular, the inclined portion 60*a* of stylus 60 contacts the concave face 1*b* of the lens 1, and the inclined portion 60*a* is shaped to have a small angle of inclination so as to form a sharp end shape. The sharp end shape of the end portion of stylus 60 can move smoothly on the lens 1, even on the surface of concave face 1*b* that has a great curvature.

Finishing Unit

As shown in FIGS. 3 and 4, the finishing unit 7, which can be displaced in the direction of the Y-axis (i.e., in the direction of the inner side of the apparatus), is disposed on an upper portion of the tool frame 53. Finishing unit 7 is also disposed to be at the inner side of the measuring unit 6 (i.e., at the right side in FIG. 4).

Figure 13:
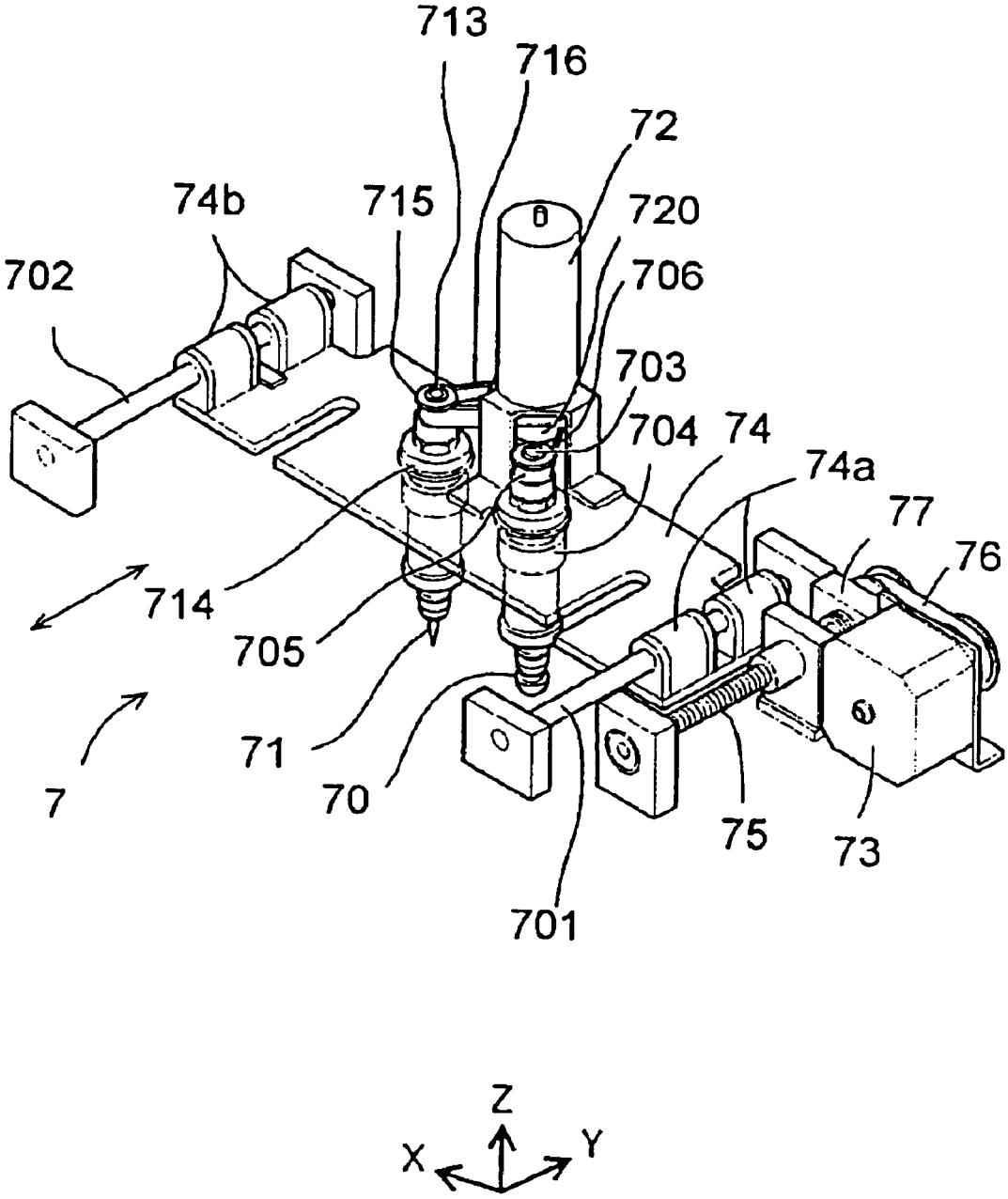
FIG. 13 shows a perspective view of the finishing unit at the retired position (also called "the waiting position).

The finishing unit 7, as shown in FIGS. 4 and 13, is constructed with (a) a base 74 that is disposed at a position above the tool frame 53 and can be displaced in the direction of the Y-axis, (b) a rotating tool 70 for chamfering the peripheral portion of the lens 1, (c) a rotating tool 71 for grooving the outer peripheral face of the lens 1, (d) a motor 72 for finishing that drives these rotating tools 70 and 71, and (e) a motor 73 for driving the finishing unit that drives the base 74 in the direction of the Y-axis. The rotating tools 70 and 71 stand in the direction of the Z-axis and are disposed at positions separated by the prescribed distance in the direction of the X-axis along the lens-holding shaft 41. Rotating tools 70 and 71 are each supported by a shaft on the base 74.

As shown in FIG. 13, a pair of guide shafts 701 and 702 are fixed to the tool frame 53 at positions separated by the prescribed distance in the directions of the Y-axis and oriented so that the shafts 701 and 702 are parallel with each other. The guide shafts 701 and 702 pass through holes penetrating stopping members 74*a* and 74*b*, respectively. Stopping members 74*a* and 74*b* are disposed at the right side and the left side of the base 74, and the right side and the left side of the base 74 are supported so that base 74 can be displaced in the direction of the Y-axis.

At the right side of FIG. 13, a screw 75 is supported by a shaft running parallel with the guide shaft 701 at the side of the tool frame 53 (i.e., at the lower side in the Figure). Screw 75 is driven by the motor 73 for driving the finishing unit. To the stopping member 74*a*, through which the guide 701 passes, a driving member 77 is fixed. Driving member 77 is engaged with the screw 75 at an outer screw formed at the inner periphery of the driving member. The base 74 is driven in the direction of the Y-axis by the displacement of the driving member 77 in the direction of the Y-axis due to the rotation of the screw 75.

The rotating tool 70 for chamfering the lens 1 is constructed to include a grinder (or a cutter) having the hemispherical shape. The rotating tool 70 for chamfering, as shown in FIG. 13, is fixed at a lower end of a shaft 703, which is disposed in the vertical direction. The shaft 703 is supported by a bearing 704 disposed on the base 74. A pulley 705 is fixed at the upper end of the shaft 703. The pulley 705 is connected through a belt 706 to a pulley 720 of the motor 72 for finishing so as to be rotated by the motor 72.

The rotating tool 71 for grooving the lens 1 is constructed to include an end mill having a narrowed tip. This rotating tool 71, as shown in FIG. 13, is fixed at the lower end of a shaft 713 that is disposed in the vertical direction. Shaft 713 is supported by a bearing 714 disposed on the base 74. A pulley 715 is fixed at the upper end of the shaft 713. The pulley 715 is connected through a belt 716 to a pulley 720 of the motor 72 for finishing so as to be rotated by the motor 72.

Since two belts 706, 716 are wound around the pulley 720 of the motor 72 for finishing, the belts 706 and 716 are disposed at offset positions in the direction of the Z-axis. As shown in FIG. 13, belt 716 is for driving the end mill and is wound at an upper position of the pulley 720. Belt 706 is for driving the rotating tool 70 that has the spherical shape and this belt is wound at a lower position of the pulley 720. Thus, the two rotating tools 70 and 71 are driven by one motor 72.

As shown in FIGS. 4 and 13, the finishing unit 7 is placed at the prescribed waiting position where processing is not conducted. In this condition, the two rotating tools 70 and 71 are placed at inner positions within the apparatus 10 (i.e., at the right side in FIG. 3) relative to the lens 1 and the styluses 60 and 61. When the finishing (i.e., the chamfering or the grooving) is conducted, as shown in FIG. 14, the two rotating tools 70 and 71 are moved to positions directly above the lens-holding shaft 41 by driving the motor 73 for driving the finishing unit.

In this condition, wherein the measuring unit 6 is at the waiting position, the rotating tools 70 and 71 advance to positions between the styluses 60 and 61. This arrangement places the styluses 60 and 61 and the rotating tools 70 and 71 on a single straight line in the direction of the X-axis, which is the processing position for the finishing unit 7.

Figure 14:
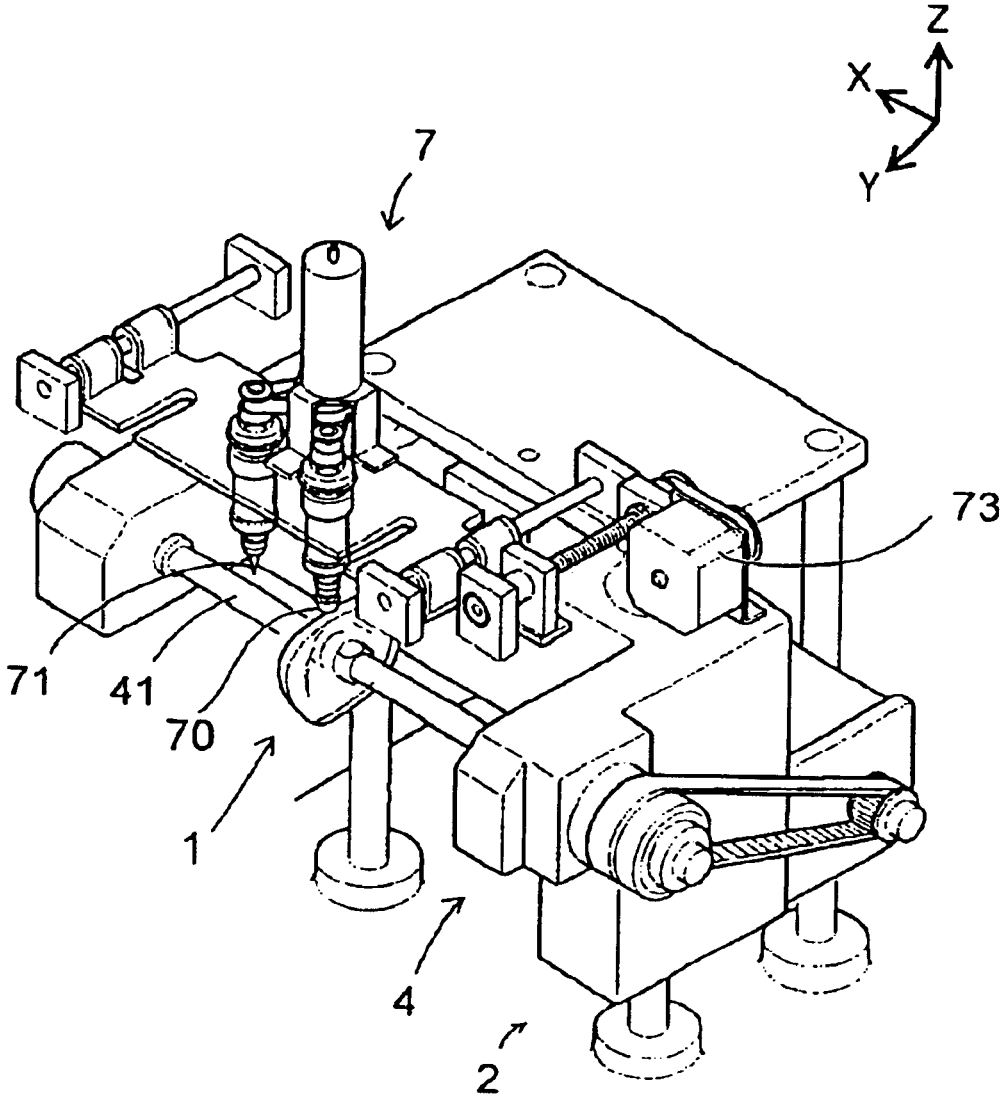
FIG. 14 shows a perspective view of the finishing unit during the chamfering.
Figure 15:
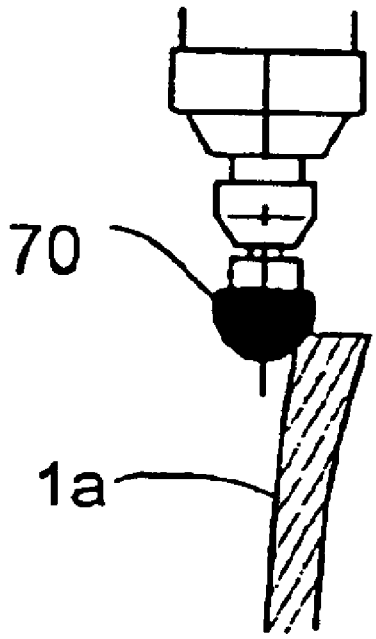
FIG. 15 shows an expanded front view of the finishing unit during the chamfering.

The finishing is conducted while the base 74 is at the advanced position shown in FIG. 14. For example, when the chamfering of the convex face 1*a* is conducted, the base unit 2 is driven in the direction of the X-axis so that the outer periphery of the convex face 1*a* is placed directly below the side face of the rotating tool 70, which has the hemispherical shape. The motor 72 for finishing is rotated and, as shown in FIG. 15, the peripheral portion of the lens 1 is brought into contact with the side face of the rotating tool 70 by elevation of the lens unit 4. The elevation of the lens unit 4 is based on the position of the peripheral portion of the lens 1, which is measured by the measuring unit 6.

The lens unit 4 is elevated or lowered in accordance with the position of the peripheral portion of lens 1, which is measured by the measuring unit 6 while the lens-holding shaft 41 is rotated and the base unit 2 is displaced in the direction of the X-axis. In this manner, the peripheral portion of the lens 1 is processed by chamfering. Since the rotating tool 70 used for the grinding or the cutting has a hemispherical shape, the angle of chamfering can be changed as desired by changing the position of the peripheral portion of lens 1 that is brought into contact with the rotating tool 70.

When grooving is conducted, the base unit 2 is displaced in the direction of the X-axis in accordance with the measured position of the lens, and the lens unit 4 is displaced in the direction of the Z-axis in accordance with the rotation angle of the lens. In this manner, the rotating tool 71, constructed to include the end mill, is faced towards the peripheral face of the lens 1, and processing is conducted to achieve the prescribed processing depth.

When the finishing is completed, base 74 is driven to the waiting position, the motor 72 for finishing is stopped, and the lens unit 4 is moved to the prescribed position for attachment and detachment of the receiver 141. Processing is thus completed.

The Cooling Unit

The cooling unit for supplying a cooling liquid during lens processing will be described as follows. The cooling unit is used for cooling the uncut lens 1 and the processing tools, and removes dust and debris generated during cutting. In the present embodiment, a cooling liquid is used comprising water as its main component.

Figure 16:
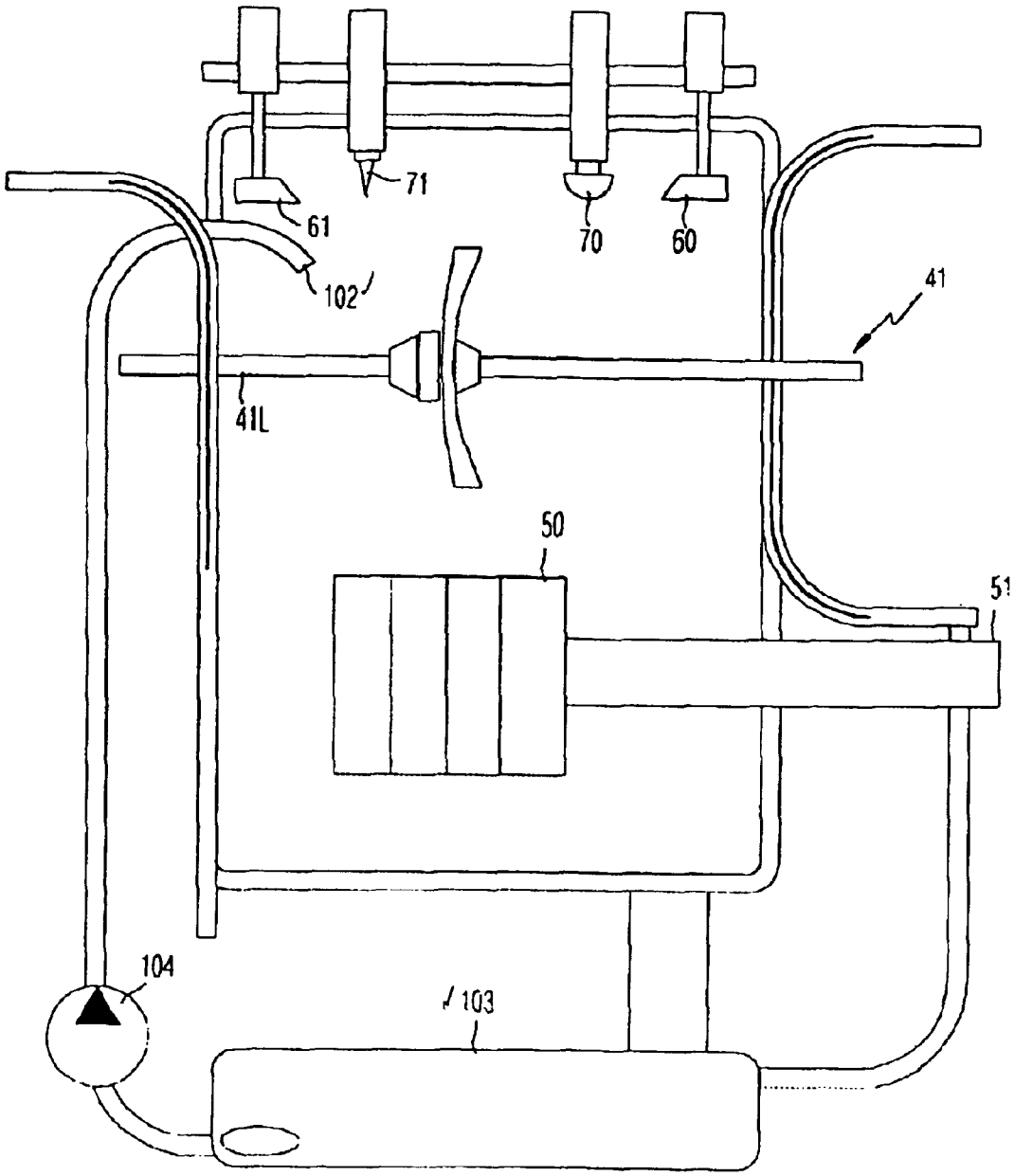
FIG. 16 shows a schematic diagram of the cooling unit.

The cooling unit, as shown in FIGS. 16 and 3, is constructed to include (a) a waterproof case 101 that has the shape of a box and that surrounds the main rotating tool 50, (b) the lens 1 supported by the lens-holding shaft 41, (c) the styluses 60 and 61 and the rotating tools 70 and 71 of the finishing unit 7, (d) a nozzle 102 for injecting the cooling liquid to the vicinity of the lens 1 that is held by the lens-holding shaft 41, (e) a tank 103 disposed at a position below the waterproof case 101, and (f) a pump 104 for sending the cooling liquid in the tank 103 to the nozzle 102 while under a pressure.

A door 14, which can be opened and closed, is disposed (refer to FIG. 1) near the waterproof case 101. When the door 14 is opened, one can access the location in the apparatus 10 where the lens 1 can be attached or detached to the receiver 141 (see FIG. 8). When the door 14 is closed, the inside of the waterproof case 101 is also tightly closed so as to prevent wetting of the bearing of the main shaft 51, the motors, the power source and the electric circuits with the scattered cooling liquid injected in the waterproof case 101.

The cooling liquid, used for cooling the lens 1 and the various rotating tools used during the processing, returns to the tank 103, is sucked into the pump 104 and re-circulated. Once the cooling liquid is used for cooling the lens 1, it contains dust formed by lens processing so a drain, which can be opened and closed, is attached to the tank 103. The drain is provided so that the dust formed by lens cutting can be removed and the dust-containing used cooling liquid can be cleaned and re-used as fresh cooling liquid.

The Control Unit

Figure 17:
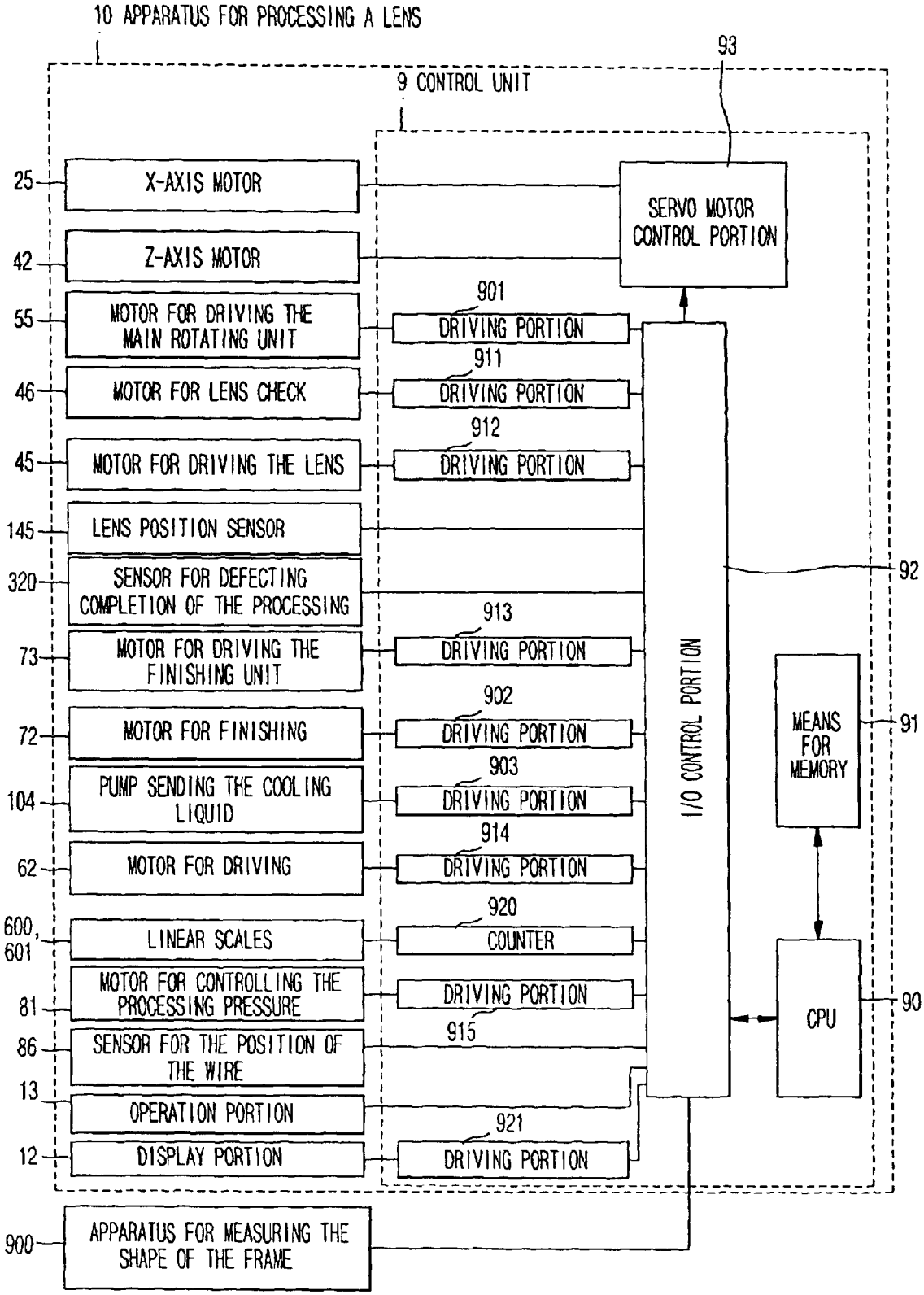
FIG. 17 is a block diagram exhibiting the construction of the control unit.

The apparatus 10 for processing a lens 10 is constructed to include the various mechanisms (units) described above, and further has a control unit 9 for controlling these various mechanisms as shown in FIG. 17.

As shown in FIG. 17, the control unit 9 includes a microprocessor (CPU) 90, a means for memory (i.e., a memory, a hard disk and the like) 91 and an I/O control portion (i.e., an interface) 92 connected to the CPU 90, which is connected to the motors and the sensors of the apparatus 10. The control unit 9 reads the data describing the shape of the lens frame that is sent from the apparatus 900 for measuring the shape of the frame. The apparatus 900 for measuring the shape of the, frame is placed outside of the apparatus 10, but it is connected to send lens frame shape data to the control unit 9. The control unit 9 also reads inputted data from various sensors, and generates various output control signals to drive the various motors of the apparatus 10 so that the prescribed processing is conducted based on the properties (i.e., the material, the hardness and the like) of the lens 1, which is set by the operation portion 13. A suitable apparatus 900 for measuring the shape of the frame is the apparatus disclosed in Japanese Patent Application Laid-Open No. Heisei 6(1994)-47656, the entire disclosure of which is incorporated herein by reference; however, other similar types of devices can be used without departing from the scope of the present invention.

The control unit 9 also comprises a servomotor control portion 93 that positions the lens unit 4 in the directions of the X-axis and the Z-axis by driving the X-axis motor 25 of the base unit 2 and the Z-axis motor 42 of the elevating and lowering unit 3.

The motor 55 for driving the main rotating unit 50, the motor 72 for finishing that drives the rotating tools 70 and 71, and the pump 104 of the cooling unit are each connected to the I/O control portion 92 via driving portions 901, 902 and 903, respectively, and the condition of rotation, or the speed of rotation, is controlled in accordance with the direction (i.e., control signals) from the microprocessor 90.

The motor 46 for the lens chuck, which controls the holding pressure applied to the lens 1 by changing the position of the shaft 41R of the lens-holding shaft 41, is connected to the I/O control portion 92 via a driving portion 911 that controls the holding pressure in accordance with the driving electric current.

The motor 45 for driving the lens is connected to the I/O control portion 92 via a driving portion 912 that controls the rotation angle of the lens 1 on the lens-holding shaft 41. The microprocessor 90 directs the processing position of the lens 1 based on the data describing the shape of the lens frame obtained from the apparatus 900 for measuring the shape of the frame. In addition to the lens frame shape data, microprocessor 90 also uses rotation angle data provided by the sensor 145 for detecting the position of the lens, which detects the rotation angle of the lens 1, to generate control signals for driving the Z-axis motor 42 so that the processing depth, in accordance with the rotation angle based on the data describing the shape of the lens frame, is achieved.

When the prescribed processing depth is achieved, a sensor 320 for detecting completion of processing, which will be described later in detail, is switched ON and the actual processing position is fed back to the microprocessor 90.

The motor 73 for driving the finishing unit, that drives the finishing unit 7 in the direction of the Y-axis, the motor 62 for driving styluses that drives the styluses 60 and 61 of the measuring unit 6, and the motor 81 for controlling the processing pressure of the unit 8 for controlling the processing pressure are each connected to the I/O control portion 92 via driving portions 913, 914 and 915, respectively. These motors 62, 73, and 81 rotate (i.e., operate) to effect positioning of the lens 1, and these motors are controlled by the microprocessor 90, which ultimately controls the positioning.

The outputs of linear scales 600 and 601 of the measuring unit 6, which are connected to measure the positions in the X-axis direction of the styluses 60 and 61, are input into a counter 920. The microprocessor 90 reads the values in the counter 920 and determines the position of the peripheral portion (i.e., the position of the finished portion) of the lens 1.

A photosensor 86 (i.e., a sensor for the position of the wire) of the unit 8 for controlling the processing pressure detects the rotation angle of the pulley 82. The microprocessor 90 receives data input from photosensor 86 and responds by driving the motor 81 for controlling the processing pressure in a manner so that the processing pressure is set and maintained in accordance with the position of the lens unit 4 in the direction of the Z-axis.

The operation portion 13, disposed on the front of the case 11 of the apparatus 10 for processing a lens, is connected to the I/O control portion 92 and transfers the direction data inputted by the operator (for example, the material of the lens 1 and whether the processing should be with or without the beveled processing or the grooving) to the microprocessor 90. Microprocessor 90 outputs the response to these operator inputted directions so that the information corresponding to the processing content is outputted to the display portion 12 via the driving portion 921.

Outline of the Processing Method

The processing procedures performed by the apparatus 10 for processing a lens that uses the control portion 9 will be described as follows with reference to FIG. 18.

Figure 18:
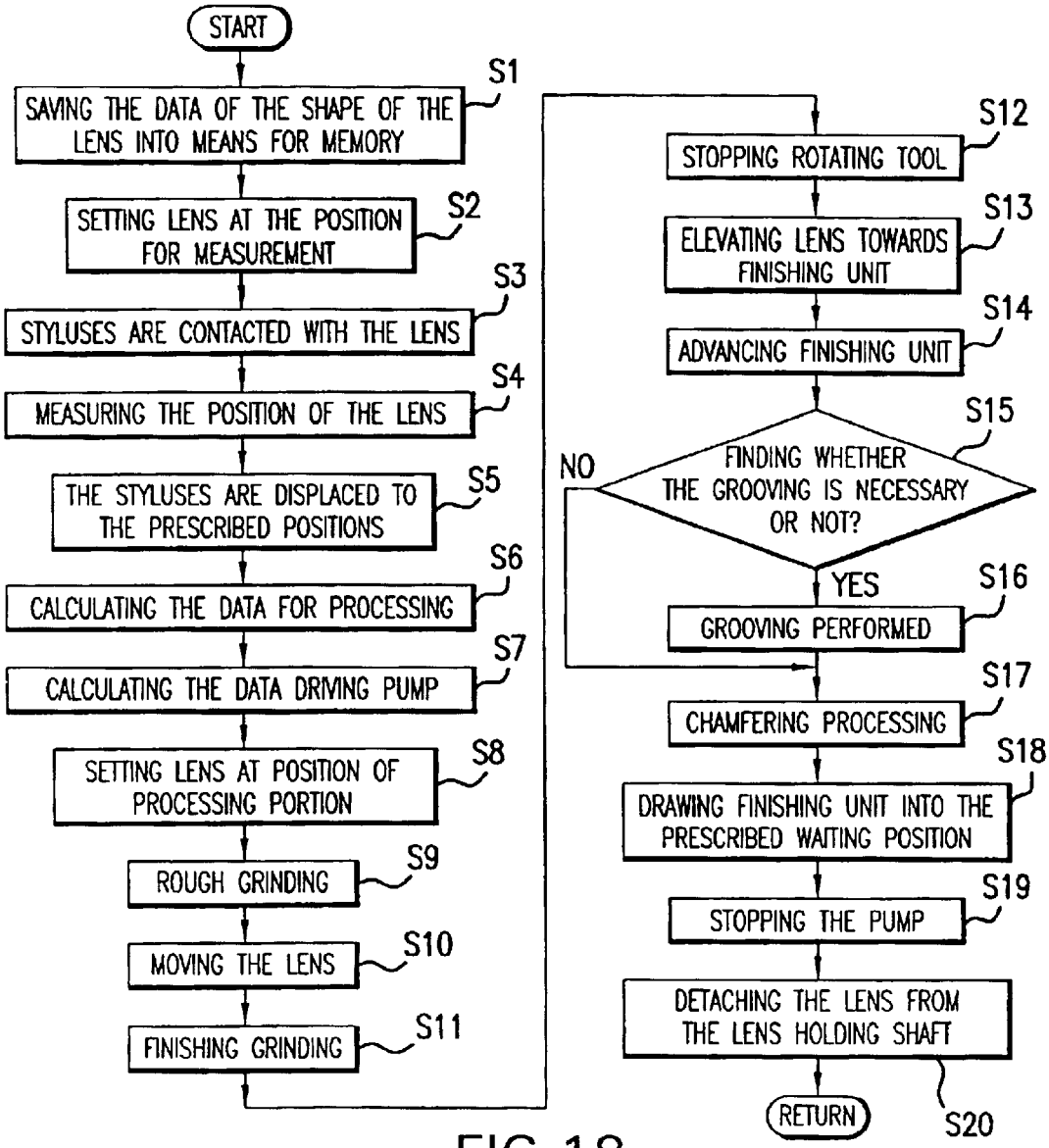
FIG. 18 is a flow chart exhibiting the procedures of controlling the processing conducted by the control unit.

As outlined in FIG. 18, the procedures conducted by the control portion 9 after the lens 1 is set into the lens-holding shaft 41 are listed. These procedures are conducted after (a) the data describing the shape of the lens frame are read from the apparatus 900 for measuring the shape of the frame, (b) the operator's direction regarding the processing conditions (i.e., the material of the lens 1 and whether the processing should be with or without the beveled processing or the grooving) is received from the operation portion 13, and (c) the direction signal for starting the processing is received from the operation portion 13 (i.e., the "start" button is pushed).

In the first step S1, after the start of the processing is directed by the operator, the pushing shaft 41R of the lens-holding shaft 41 is displaced to the lens holding position shown in FIG. 8 by driving the motor 46 for the lens chuck. In addition, the holding pressure is set by the microprocessor 90 in accordance with the material, and the data describing the shape of the lens frame provided by the apparatus 900 for measuring the shape of the frame are saved into the memory of the means for memory 91. In the second step: S2, the lens unit 4 is elevated and set at the measurement position.

In the third step S3, the styluses 60 and 61 are brought into contact with the convex face 1*a* and the concave face 1*b*, respectively, of the lens 1 by driving the motor 62 for driving the styluses (refer to FIG. 12). Thereafter, in the fourth step S4, the lens 1 is rotated by driving the motor 46 for driving the lens. The lens unit 4 is elevated or lowered to the appropriate position in accordance with the rotation angle of the lens 1 (i.e., the position of the complete processing on the peripheral portion of the lens) based on the data describing the shape of the lens frame (i.e., the data of the peripheral portion of the lens 1). Then, the position of complete processing on the lens 1 is measured and stored into the means of memory 91.

When measurement of the complete processing position on the entire periphery of the lens is completed, the outline moves to the fifth step S5. In step S5, the motor 62 for driving the styluses is driven in the direction of the waiting positions and the styluses 60 and 61 are displaced to the prescribed waiting positions.

In the sixth step S6, the processing data (for example, the processing depth at every rotation angle of the lens 1) are calculated based on the data describing the shape of the lens frame previously read and stored from the apparatus 900 for measuring the shape of the frame. Next, in the seventh step S7, processing of the lens 1 is conducted in step S7 and in several steps thereafter.

In step S7, the main rotating tool 50 is rotated by driving the motor 55 and the cooling liquid is injected towards the lens 1 by driving the pump 104.

In the eighth step S8, the lens unit 4 is lowered and the base unit 2 is displaced in the direction of the X-axis to the position where the peripheral portion of the lens 1 faces towards the rough grinder 50*a* for flat grinding of the main rotating tool 50. In the ninth step S9, the processing depth is effected by the elevating and lowering unit 3 while the lens is rotated by the motor 45 for driving the lens. During step S9, rough grinding is conducted to the processing depth calculated at every rotation angle of the lens-holding shaft 41.

When the sensor 320 for detecting completion of the processing detects completion of the processing and gives the ON signal, for the entire lens periphery, then the microprocessor 90 decides that the rough grinding is completed.

After the rough processing is completed, the outline moves to the tenth step S10, wherein the lens unit 4 is temporarily elevated. In step S10, the base unit 2 is moved in the direction of the X-axis to the position where the lens 1 faces towards the finishing grinder 50*b* for flat grinding of the main rotating tool 50. In the eleventh step S11, the finishing grinding is conducted at the speed of rotation of the motor 55 in accordance with the processing depth and the finishing grinding calculated at every rotation angle by the microprocessor 90.

When the finishing grinding is completed, the outline moves to the twelfth step S12, wherein the lens 1 is separated from the main rotating tool 50 by elevating the lens unit 4 and the motor 55 is stopped. Then in the thirteenth step S13, the lens unit 4 is elevated towards the finishing unit 7.

In the fourteenth step S14, the rotating tools 70 and 71 are advanced to the prescribed position for processing by the motor 73 for driving the finishing unit.

In the fifteenth step S15, the microprocessor 90 determines whether grooving is necessary or not based upon operator instructions provided before initiation of step S1. When grooving is necessary, the grooving is conducted in the sixteen step S16 before the outline moves on to the seventeenth step S17. When the grooving is not necessary, the outline moves directly to the seventeenth step S17 and the chamfering is conducted without the grooving step.

In the grooving of step S16, the motor 72 for finishing is driven and the outer peripheral face of the lens 1 is pressed to the tip of the rotating tool 71 that is constructed with the end mill. The lens unit 4 is displaced to the position where the outer peripheral face of the lens 1 faces towards the rotating tool 71 by driving the base unit 2 in the direction of the X-axis. Then, the grooving of the outer peripheral face is conducted by the end mill while the lens unit 4 is elevated and driven in the directions of the Z-axis and the X-axis in accordance with the peripheral shape of the lens 1 (i.e., the position measured in step S2) to provide the prescribed processing depth.

In the chamfering of step S17, as shown in FIGS. 14 and 15, the motor 72 for the finishing is driven and the side face of the convex side or the concave side at the peripheral portion of the lens 1 is pressed to the side portion of the rotating tool 70 that has the hemispherical shape. The chamfering grinding is conducted by driving the lens unit 4 to the directions of the X-axis and the Z-axis in accordance with the peripheral shape (i.e., the position measured in step S2) of the convex side or the concave side of the lens 1 to provide the prescribed processing depth (i.e., the angle of chamfering). When the chamfering on one of the convex side and the concave side of the lens 1 is completed, the lens unit 4 is temporarily lowered, then moved to the direction of the X-axis (i.e., to the right side in FIG. 3) by the base unit 2 so that the lens unit 4 is used for processing the other face of the lens 1. The lens unit 4 is, then, elevated again and the other face of the lens is chamfered.

When the chamfering is completed, the outline moves to the eighteenth step S18, wherein the finishing unit 7 is drawn into the prescribed waiting position and the motor 72 for finishing is stopped. Then in the nineteenth step S19, the lens unit 4 is lowered to the prescribed position for attachment and detachment of the lens from the receiver 141, and the injection of the cooling liquid is stopped by stopping the pump 104.

In the final step of S20, the pushing shaft 41R of the lens-holding shaft 41 is displaced to the position for attachment and detachment of the lens from the receiver 141, as shown in FIG. 9, by driving the motor 46 for the lens chuck and the lens processing is completed.

Workings of the Apparatus in Accordance with the Present Invention

As described above and in accordance with the present invention, the lens unit 4 holding the lens 1 is elevated or lowered along the vertical line of the main rotating tool 50 fixed on the base plate so that the lens 1 is processed, while the lens-holding shaft 41 is rotated, into the desired shape of the peripheral portion in accordance with the data describing the shape of the lens frame. In the calculation of the processing data conducted in step S6 of the method described above, the processing depth is calculated in accordance with the position where the lens 1 contacts the main rotating tool 50. The elevating and lowering unit 3 is driven to the position in the direction of the Z-axis to provide the calculated processing depth. Therefore, the time required for converting the data describing the shape of the lens frame to the data necessary for processing can be decreased in comparison with the time required for converting the processing depth into the swing angle of an arm that supports a swinging lens-holding shaft, such as in the conventional prior art methods and apparatuses discussed above. Thus, the period of time measured from the moment the operator directs the starting of the lens processing to the moment lens processing actually starts can be decreased so that the entire processing time, which includes this time period from start signal to actual lens processing, can be decreased.

When deciding the processing depth of the lens 1, because the peripheral position 1', in accordance with the data describing the shape of the lens frame as shown in FIG. 19, is placed on the straight line connecting the axial line 51*c* of the main shaft 51 and the axial line 41*c* of the lens-holding shaft 41 when the rotation angle of the lens-holding shaft 41 is 0 degree, the processing depth is decided to be on the axial line 51*c* of the main shaft and the axial line 41*c* of the lens-holding shaft.

However, when the axial line 41*c* of the main shaft is at the position rotated by 90 degrees, because the outer periphery of the lens 1 and the main rotating tool 50 are brought into contact with each other at the position shown by m in FIG. 19, the correction for the processing depth at the position of contact m, which is deviated from the straight line connecting the two axial lines 41*c* and 51*c*, is made by calculation.

When the uncut lens 1 has a circular shape and is processed based on the data describing the shape of the lens frame (i.e., the numerical data), the processing data is treated by calculation as described above. Since the calculation of the floating point is frequently used in the calculation of the correction at the deviated position of contact m, the calculation load on the microprocessor 90 in the control portion 9 increases.

When the arm of the lens-holding shaft is swung as is conducted in the conventional methods and apparatuses, the processing depth must be further converted into the swing angle of the arm. Therefore, the calculation load on the microprocessor 90 further increases and the accuracy of finishing decreases due to error in the swing angle.

In contrast, in accordance with the present invention, when the position of contact is on the axial line of the main shaft 51 and the lens-holding shaft 41, the processing depth can be set at the same value as the amount of displacement of the lens unit 4 so that the calculation load on the microprocessor 90 can be decreased. Because the lens-holding shaft 41 is elevated or lowered only along the vertical line of the axial line 51*c* of the main shaft 51, easier and more accurate positioning can be made in comparison with the prior art method of controlling the swing angle. The processing accuracy of the lens 1 in accordance with the data describing the shape of the lens frame can be increased without requiring that microprocessor 90 be a microprocessor having a great processing ability. Therefore, the cost of manufacturing an apparatus in accordance with the present invention can be suppressed rather than increased.

Because the lens-holding shaft 41 and the styluses 60 and 61 are arranged on the vertical line (i.e., the Z-axis) of the axial line of the main rotating tool 50 disposed on the base plate 15, and the rotating tool 70 for chamfering and the rotating tool 71 for grooving can be freely advanced to or retired from the vertical line of the main shaft 51, the apparatus 10 can switch between main processing and finishing processing, and measurement of the complete processing position can be made by elevating or lowering the lens unit 4. Therefore, the displacement of the various component mechanisms can be reduced to a minimum and operational control is facilitated. In particular, switching between the processing position and the waiting position for the finishing unit 7 can be made just by advancing and retiring the rotating tools 70 and 71. In accordance with the present invention, it is sufficient that the positioning is carried out by detecting the position using a limit switch, or the like, so that positioning with a great accuracy can be achieved without the need for complicated control mechanisms and algorithms.

When pressure is applied to the lens 1, as shown in FIG. 6, the weight of the lens unit 4 itself is applied to the lens 1 by lowering the positioning member 34 to a position below the position where the lens 1 contacts the main rotating tool 50. The load thus applied by the lens unit 4, which is supported by the unit 8 for controlling the processing pressure, is adjusted in accordance with the tension of the spring 84.

Since the unit 8 for controlling the processing pressure, which adjusts the processing pressure to a desired value, operates following the elevation and the lowering of the lens unit 4, the optimum processing pressure can be maintained at an approximately constant value that is suitable for both the material and the thickness of the peripheral portion of the lens 1. Therefore, the finishing accuracy can be improved while the processing time is decreased.

In recent years, the types of the material used for the lens 1 has diversified. In addition to the various choices between glass-based materials and resin-based materials, the variety within the resin-based materials, such as plastic lenses (CR-based lenses), polycarbonate-based lenses and urethane-based lenses, is increasing. This situation causes a problem in that, unless the processing pressure is finely adjusted in accordance with the type of lens material to be processed, the size of dust and debris formed by grinding or cutting does not have the optimum value and the quality of the finished surface (i.e., the roughness and the presence or the absence of defects) decreases.

As shown in FIG. 10, the processing pressure that is the most suited for the particular-type of material of the lens 1 can be determined. Consequently, an excellent finishing face can be achieved when the relation between the amount of unwinding of the wires 83 relative to the position of the lens unit 4 in the direction of the Z-axis (i.e., in other words, the tension of the spring 84=the load to be subtracted from the weight of the lens unit 4) and the material of the lens 1 to be processed is set in advance before lens processing. In this manner, the processing pressure most suitable for the lens material is selected using the properties shown in FIG. 10 in accordance with the material of the lens selected or inputted by the operator using the operation portion 13 before the processing of lens 1.

By placing the lens unit 4 on the base unit 2, which can be displaced along the direction of the X-axis i.e., the axial direction of the main shaft 51), switching between the plurality of tools 50*a* to 50*d*, switching between the rotating tool 70 for the chamfering and the rotating tool 71 for the grooving, and switching between the convex face 1*a* and the concave face 1*b* of the lens 1 for the chamfering can be readily conducted. Due to these switching operations, the positioning accuracy can be improved in comparison with the case in which each unit can be displaced.

When each unit can be displaced, the backlash of the unit and the error in positioning are different for each unit, so it is difficult to achieve improvement in the positioning accuracy of the entire apparatus. In contrast, in accordance with the present invention, the positioning accuracy in the direction of the X-axis is determined by the positioning accuracy of the base unit 2 since the lens unit 4 is disposed on the base unit 2. Therefore, the processing can be conducted with improved accuracy and the accuracy of the finished lens 1 can be improved.

Because the lens-holding shaft 41 and the measuring unit 6 are arranged on the vertical line of the axial line 51 of the main rotating tool 50 that is disposed on the base plate 15, and because the finishing unit 7 can freely advance to and retire from the vertical line of the main shaft 51, the entire apparatus 10 is constructed in a manner such that the component units are laid successively in the vertical direction. As a result, the area required for unit installation within the apparatus 10 can be decreased so the apparatus 10 can be made smaller and more compact.

In the above embodiment, in the unit 8 for controlling the processing pressure, the weight of the lens unit 4 is adjusted in accordance with the tension of the spring 84. Alternately, the wire 83 can be made of an elastic material so that there is no need for the spring 84. In other words, by making wire 83 out of a suitable elastic material, the present invention can be practiced without spring 84.

In the above embodiment, the unit 8 for controlling the processing pressure has the construction wherein the lens unit 4 is suspended from an upper position. Alternatively, the lens unit 4 may be pushed up from a lower position to the upward direction without departing from the scope of the present invention.

In the above embodiment, the unit 8 for controlling the processing pressure has the construction in which a portion of the weight of the lens unit 4 is supported by the spring 84. Alternatively, the lens unit may be directly suspended by the wire 83, and the processing pressure applied to the lens 1 may be adjusted in accordance with the force of driving, or the amount of driving, of the motor 81.

In the above embodiment, the finishing unit 7 can be freely moved in the direction of the Y-axis. Alternatively, the finishing unit 7 may be fixed on the vertical line of the lens-holding shaft 41. In this case, the measuring unit may be allowed to be freely moved in the direction of the Y-axis.

While the present invention has been described with reference to certain illustrative embodiments, one of ordinary skill in the art will recognize that additions, deletions, substitutions, modifications and improvements can be made while remaining within the spirit and scope of the present invention as defined by the appended claims.

What is claimed is:

1. An apparatus for processing a lens, which processes a peripheral portion of a spectacle lens in accordance with data describing a shape of a lens frame, the apparatus comprising:

a lens-holding unit that is freely displaceable in a vertical direction and comprises a holding shaft that holds the lens so that the lens is freely rotateable around a second shaft disposed in a horizontal direction, and a means for detecting a rotation angle of the holding shaft;

a processor, disposed at a position below the holding shaft, disposed to process a peripheral portion of the lens;

an elevating and lowering unit disposed to hold the lens-holding unit when the lens-holding unit is elevated, wherein the elevating and lowering unit optionally separates from the lens-holding unit when the lens-holding unit is lowered, wherein the elevating and lowering unit displaces to a first position in a vertical direction that is determined in accordance with a processing amount, wherein the processing amount is determined in accordance with a rotation angle of the holding shaft and the data describing the shape of the lens frame;

wherein when the lens-holding unit is lowered and the lens contacts the means for processing, the elevating and lowering unit separates from the lens-holding unit, wherein the lens-holding unit is further lowered to the first position in the vertical direction in accordance with the processing amount, wherein the processing amount is based on the specific value of the rotation angle of the holding shaft and the data describing the shape of the lens frame, and the lens-holding unit presses the lens to the means for processing in the vertical direction under a load determined in accordance with a weight of the lens-holding unit until the lens-holding unit is brought into contact with the elevating and lowering unit.

2. An apparatus according to claim 1, wherein the processor comprises a main shaft disposed on a base plate in a direction parallel with the holding shaft on a vertical line of the holding shaft, and a plurality of rotating tools are disposed at the main shaft; and the elevating and lowering unit is supported by a table that is displaceable on the base plate in an axial direction of the main shaft.

3. An apparatus according to claim 2, further comprising a means for measurement, which measures a position of the lens in an axial direction of the holding shaft, fixed at a position above the holding shaft.

4. An apparatus according to claim 1, further comprising a means for finishing, which finishes the lens, disposed at a position above the holding shaft.

5. An apparatus according to claim 4, wherein the means for finishing is supported so that the means for finishing is displaceable in a horizontal direction perpendicular to a holding axis.

6. An apparatus according to claim 5, further comprising a means for controlling a processing pressure that supports a portion of the weight of the lens-holding unit when processing pressure is controlled, wherein the means for controlling a processing pressure is disposed on the table.

7. An apparatus according to claim 6, wherein the means for controlling a processing pressure comprises a means for supporting a load that follows displacement of the lens-holding unit in the vertical direction and that constantly supports a load set in advance.

8. An apparatus according to claim 7, wherein the means for supporting a load comprises an elastic member, and the supported load is set in accordance with a tension of the elastic member.

9. An apparatus according to claim 8, wherein the means for supporting a load further comprises a wire that is freely wound on a means for winding, wherein the means for winding winds or unwinds the wire, and the elastic member connects the wire and the lens-holding unit.

10. An apparatus according to claim 9, wherein the means for winding comprises a pulley on which the wire is wound, and an actuator that drives the pulley wherein the pulley and the actuator are connected via a worm gear.

11. An apparatus according to claim 7, further comprising a means for inputting a processing condition for a lens; a means for setting a processing pressure that is predetermined in accordance with the processing condition for the lens; and a means for control that controls the load supported by the means for controlling a processing pressure.

12. An apparatus according to claim 11, wherein the means for control maintains the processing pressure in accordance with the processing condition for the lens and the displacement of the lens-holding unit.

* * * * *